US006633734B2

(12) United States Patent
Maebashi et al.

(10) Patent No.: US 6,633,734 B2
(45) Date of Patent: Oct. 14, 2003

(54) IMAGE FORMING APPARATUS HAVING DENSITY DETECTING MEANS

(75) Inventors: Yoichiro Maebashi, Shizuoka (JP); Koichi Hiroshima, Shizuoka (JP); Tomoaki Nakai, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/062,549

(22) Filed: Feb. 5, 2002

(65) Prior Publication Data

US 2002/0110381 A1 Aug. 15, 2002

(30) Foreign Application Priority Data

Feb. 9, 2001 (JP) ..... 2001-034255

(51) Int. Cl.[7] ..... G03G 15/00
(52) U.S. Cl. ..... 399/49; 399/74
(58) Field of Search ..... 399/49, 72, 74, 399/46; 250/341.8; 356/446, 448

(56) References Cited

U.S. PATENT DOCUMENTS

| | | | | |
|---|---|---|---|---|
| 6,070,022 A | | 5/2000 | Kobayashi et al. | 399/12 |
| 6,104,891 A | | 8/2000 | Maebashi et al. | 399/55 |
| 2002/0006288 A1 | * | 1/2002 | Funatani | 399/49 |
| 2002/0098005 A1 | * | 7/2002 | Takeuchi et al. | 399/49 |

FOREIGN PATENT DOCUMENTS

| | | | |
|---|---|---|---|
| JP | 05-322759 | * | 12/1993 |
| JP | 6-66722 | | 3/1994 |
| JP | 9-284556 | | 10/1997 |
| JP | 2000-39746 | * | 2/2000 |
| JP | 2000-258966 | | 9/2000 |

* cited by examiner

*Primary Examiner*—Sophia S. Chen
(74) *Attorney, Agent, or Firm*—Fitzpatrick, Cella, Harper & Scinto

(57) ABSTRACT

An image forming apparatus has an image bearing member, and a density detecting device for detecting the density of an image for density detection formed on the image bearing member. Image forming conditions are controlled on the basis of an output from the density detecting device. The density detecting device has a regular reflection type density detecting device for detecting the density by regular reflection light from a portion to be detected, and a diffuse reflection type density detecting device for detecting the density by diffuse reflection light from the portion to be detected. The output value from the diffuse reflection type density detecting device is corrected on the basis of the output value from the regular reflection type density detecting device which has detected a reference image, and the output value from the diffuse reflection type density detecting device which has detected the reference image.

28 Claims, 15 Drawing Sheets

IMAGE FORMING APPARATUS HAVING DENSITY DETECTING MEANS

BACKGROUND OF THE INVENTION

1. Field of the Invention

The invention relates to an image forming apparatus such as a copier or a printer utilizing the electrophotographic process, and particularly to a color image forming apparatus for forming a color image comprising toner images of a plurality of colors superimposed one upon another.

2. Description of Related Art

Generally in an image forming apparatus of the electrophotographic type, a fluctuation occurs to the density characteristic of a printed image due to the environment of use, the fluctuations of the characteristics of a developing device and a photosensitive drum by the number of printed sheets, the unevenness of the sensitivity of the photosensitive drum during the manufacture thereof, the unevenness of the triboelectrification characteristic of a toner during the manufacture thereof, etc.

An effort to stabilize these variations and fluctuation characteristics is made every day, but is still insufficient. Particularly in a color image forming apparatus, color reproduction is effected with developers (toners) of four colors, i.e., yellow, magenta, cyan and black, superimposed one upon another and therefore, unless the density of developed images, i.e., toner images, of the four colors is accurately adjusted, good color balance cannot be obtained.

Accordingly, in many color image forming apparatuses, there is mounted an image density adjusting mechanism for automatically adjusting image forming conditions such as charging potential, exposure amount and developing bias. A popular method for the image density adjustment is as follows.

First, toner images are formed on an image bearing member or a transfer material bearing member under predetermined image forming conditions, and the density of the toner images is detected by an optical sensor (density sensor) comprising a light emitting element and a light receiving element. Then the image forming conditions are adjusted in conformity with the detected density of the toner images.

In that case, it is known that if density detection is effected by using a regular reflection type sensor great in the light receiving amount and excellent in sensitivity for a black toner, and using a diffuse reflection (irregular reflection) type sensor high in the detection accuracy of high density for the toners of the other colors, i.e., yellow, magenta and cyan, the performance of density control is good, and the method is adopted in many color image forming apparatuses.

Mentioning an example, a toner density detecting apparatus according to Japanese Patent Application Laid-Open No. 6-66722 is an apparatus for applying the light of a light emitting element to an image bearing member on which toner images are formed, and detecting the reflected light thereof by a light receiving element to thereby detect the density of the toners on the image bearing member, and adopts a construction in which a light receiving element for black is disposed at a position for detecting regular reflection light of the reflected light and a light receiving element for colors are disposed at a position for detecting irregular reflection light of the reflected light.

When use is made of the optical type density detecting means, i.e., density sensor, as described above, density detection accuracy is aggravated by the influence of a fluctuation in the quantity of light of the light emitting element and a fluctuation in the light receiving characteristic of the light receiving element, or the unevenness of the attached position of the density sensor, and further a fluctuation in the surface characteristic of the image bearing member or the transfer material bearing member for forming the toner images to be detected, etc. and therefore, correction need be effected by some method.

In the case of the popular regular reflection type density sensor, there is known a method of normalizing the read value of a toner pattern by the density sensor by the detection value (background output value) when the background of an image bearing member or a transfer material bearing member on which the toner pattern is formed is detected by the sensor.

On the other hand, in the case of the diffuse reflection type density sensor, unless the image bearing member or the transfer material bearing member which is the background is of other color than black and the surface characteristic (reflectance) thereof is stable at a predetermined value, the normalizing correction as described above cannot be effected and therefore, the correction of the output value has been difficult. Accordingly, regarding the correction of the diffuse reflection type density sensor, other method is used.

As a conventional example of the correction of the diffuse reflection type sensor, there is a method described in Japanese Patent Application Laid-Open No. 9-284556. An image forming apparatus described in the publication has latent image forming means for forming the latent image of a test pattern on a photosensitive member, developing means for visualizing the latent image, an intermediate transfer member to which the visualized test pattern is transferred, a density sensor for detecting the density of the test pattern, and a reference calibration member in the vicinity of the intermediate transfer member, and is designed to detect the quantity of reflection light of the reference calibration member by a density sensor, and effect gray level correction on the basis of the output value of the density sensor at this time.

As another conventional example, there is a method according to Japanese Patent Application Laid-Open No. 12-258966. The image forming apparatus of the publication is designed to form a pattern for density detection on an image bearing member, a transfer material bearing member or an intermediate transfer member, and in detecting the density of the pattern for density detection by diffuse reflection type and regular reflection type density detecting sensors, normalize the value when the density of the pattern for density detection is detected by the diffuse reflection type density detecting sensor on the basis of the value when the surface of the image bearing member, the transfer material bearing member or the intermediate transfer member is detected by the regular reflection type density detecting sensor.

However, the image forming apparatuses using the correcting method of the diffuse reflection type density sensor as described above have suffered from the following inconveniences.

In the case of the image forming apparatus according to Japanese Patent Application Laid-Open No. 9-284556, it is necessary to newly provide the reference calibration member, and this has resulted in an increase in the number of parts and an increase in costs and the bulkiness of the apparatus. Further, there has been the problem that when the unevenness of the reference calibration member is great, correction accuracy becomes bad, that is, the unevenness of density is made great.

Also, the image forming apparatus according to Japanese Patent Application Laid-Open No. 12-258966 has been effective to correct the unevenness of the quantity of light of the light emitting element, but has been in appropriate for correcting an output fluctuation caused by a reduction in the reflectance of the background and the positional deviation of the sensors. The reason for this will hereinafter be described briefly.

Description will first be made of a case where the quantity of light of the light emitting element of the density sensor has fluctuated. In this case, the light reception outputs of regular reflection light and diffuse reflection light fluctuate at the same rate. Accordingly, if the variable ratio of the regular reflection output value to the background is detected, it is possible to correct the diffuse reflection output by the use of the variable ratio.

On the other hand, when the gloss (reflectance) of the image bearing member or the transfer material bearing member fluctuates, there is a fluctuation about the regular reflection output, but no variation occurs to the diffuse reflection output. Accordingly, if the diffuse reflection output is corrected by the use of the fluctuation rate of the regular reflection output with respect to the background, unnecessary correction is added to the diffuse reflection output which is originally free of fluctuation and all the more, detection accuracy is aggravated. Also, when the positional deviation of the sensors occurs, the regular reflection output strong in directionality fluctuates, but the diffuse reflection output value weak in directionality scarcely fluctuates and therefore, a similar inconvenience occurs.

As described above, the method of diffuse reflection correction described in Japanese Patent Application Laid-Open No. 12-258966 is appropriate in some case and inappropriate in some case in conformity with the fluctuation factors of the output. However, it is very difficult to specify the factors (the fluctuation of the quantity of emitted light, the fluctuation of the background and the positional deviation of the sensors) by which the sensor outputs have been fluctuated. Therefore, when the correcting method is used, the limitation that the fluctuation of the background and the positional deviation of the sensors do not occur becomes necessary. Thus, the method could not be said to be the practically optimum method.

SUMMARY OF THE INVENTION

It is an object of the present invention to provide an image forming apparatus which does not require a member such as a reference calibration plate to be newly added and can cope with the fluctuation factors of the output of a density sensor and effect the correction of the sensor output.

It is another object of the present invention to provide an image forming apparatus which is low in cost and excellent in the stability of color reproduction.

It is another object of the present invention to provide an image forming apparatus having an image bearing member or a transfer material bearing member, and density detecting means for detecting the density of an image for density detection formed on the image bearing member or the transfer material bearing member, wherein image forming conditions are controlled on the basis of an output from the density detecting means, the density detecting means has regular reflection type density detecting means for detecting the density by regular reflection light from a portion to be detected, and diffuse reflection type density detecting means for detecting the density by diffuse reflection light from the portion to be detected, and the output value from the diffuse reflection type density detecting means is corrected on the basis of the output value from the regular reflection type density detecting means which has detected a reference image and the output value from the diffuse reflection type density detecting means which has detected the reference image.

It is another object of the present invention to provide an image forming apparatus having an image bearing member or a transfer material bearing member, and density detecting means for detecting the density of an image for density detection formed on the image bearing member or the transfer material bearing member, wherein image forming conditions are controlled on the basis of an output from the density detecting means, the density detecting means has regular reflection type density detecting means for detecting the density by regular reflection light from a portion to be detected, and diffuse reflection type density detecting means for detecting the density by diffuse reflection light from the portion to be detected, and the output value from the diffuse reflection type density detecting means is corrected on the basis of the output value from the regular reflection type density detecting means which has detected a reference image, the output value from the diffuse reflection type density detecting means which has detected the reference image, and an output value obtained by detecting the surface of the image bearing member or the transfer material bearing member by the diffuse reflection type density detecting means.

Further objects of the present invention will become apparent from the following description.

DESCRIPTION OF THE PREFERRED EMBODIMENTS

A color image forming apparatus according to the present invention will hereinafter be described in greater detail with reference to the drawings.

Embodiment 1

Figure 1:
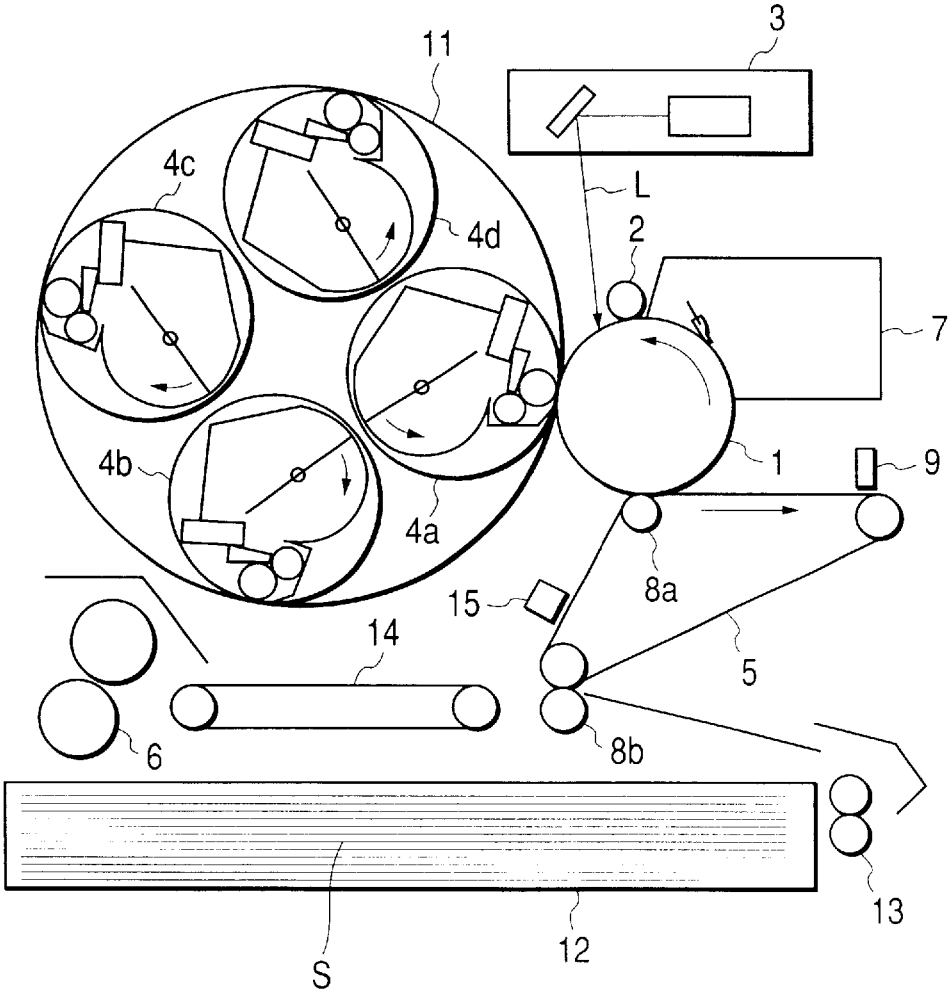
FIG. 1 shows an image forming apparatus which is an embodiment of the present invention.

FIG. 1 is a cross-sectional view showing an embodiment of the color image forming apparatus of the present invention. The color image forming apparatus of the present embodiment will hereinafter be described with reference to the drawings. In the present embodiment, the color image forming apparatus has a photosensitive drum 1 as a first image bearing member which is a drum-shaped electrophotographic photosensitive member, and an intermediate transfer member which is a second image bearing member, i.e., in the present embodiment, an intermediate transfer belt 5.

The photosensitive drum 1 which is the first image bearing member is driven in the direction indicated by the arrow in FIG. 1 by driving means (not shown), and has its surface uniformly charged by a primary charger 2. Then, a laser beam L conforming to a yellow image pattern is applied from an exposing device 3 to the photosensitive drum 1, whereby a latent image is formed on the outer peripheral surface of the photosensitive drum 1. When the photosensitive drum 1 further advances in the direction indicated by the arrow, among developing devices 4*a,* 4*b,* 4*c* and 4*d* supported by a rotary supporting member 11, the developing device 4*a* containing a yellow (Y) toner therein is rotated so as to be opposed to the photosensitive drum 1, and the latent image is developed by the selected yellow developing device 4*a,* and is visualized as a yellow toner image.

The intermediate transfer belt 5 which is the second image bearing member is rotated in the direction indicated by the arrow in FIG. 1 substantially at the same speed as that of the photosensitive drum 1, and the toner image formed on the photosensitive drum 1 is primary-transferred to the outer peripheral surface of the intermediate transfer belt 5 by a primary transfer bias applied to a primary transfer roller 8*a*. The above-described process is carried out for each of magenta (M), cyan (C) and black (K), whereby toner images comprising the four colors, i.e., yellow, magenta, cyan and black, superimposed one upon another are formed on the intermediate transfer belt 5.

Correspondingly to the image formation on the intermediate transfer drum 5, a transfer material S which is a recording material is taken out of a transfer material cassette 12 at predetermined timing by a pickup roller 13, and is fed to the intermediate transfer belt 5 by conveying rollers (not shown). At the same time, a secondary transfer roller 8*b* is brought into contact with the intermediate transfer belt 5 with the transfer material interposed therebetween, and the toner images of the four colors on the intermediate transfer belt 5 are collectively secondary-transferred to the transfer material by a secondary transfer bias applied to the secondary transfer roller 8*b*.

The transfer material to which the toner images of the four colors have been transferred is conveyed to a fixing device 6 by a conveying belt 14, and is heated and pressurized there, whereby the toners are fused and fixed and a full-color fixed image is obtained on the transfer material. Any untransferred toners on the intermediate transfer belt 5 are removed by an intermediate transfer belt cleaner 15. On the other hand, any untransferred toners on the photosensitive drum 1 are removed by a cleaning device 7 having a blade.

The color image forming apparatus of the present embodiment is provided with an image density controlling mechanism for automatically adjusting image density. In the present embodiment, the intermediate transfer belt 5 which is the second image bearing member is used as a density detecting medium, and the image density controlling mechanism stepwisely changes image forming conditions for the photosensitive drum 1 to thereby form a plurality of toner images (pattern) for density detection, and transfers the pattern onto the intermediate transfer belt 5, and measures the quantity of reflected light regarding the pattern on the intermediate transfer belt 5 by a density sensor 9, and calculates image forming conditions under which desired density (quantity of reflected light) is obtained on the basis of the result of the measurement, thereby effecting the control of the image density.

Figure 2:
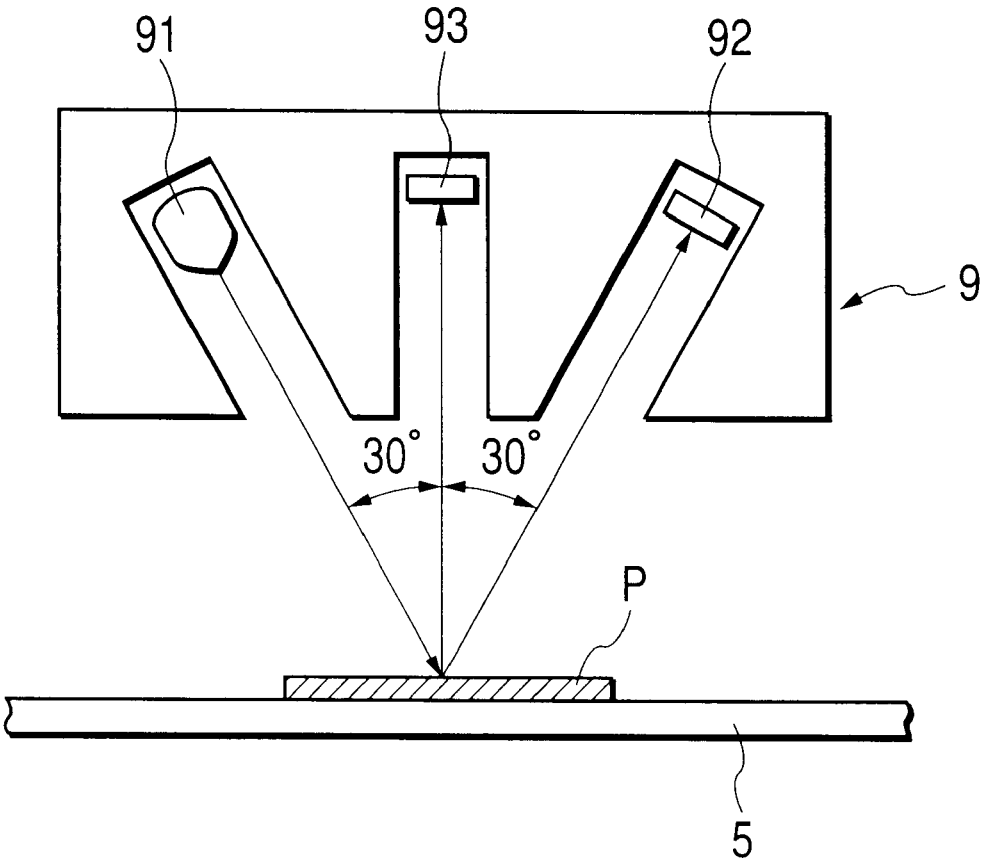
FIG. 2 shows a density sensor used in the image forming apparatus of FIG. 1.

According to the present embodiment, the density sensor 9 as density detecting means, as shown in FIG. 2, is a compound sensor formed into one united body comprising a regular reflection type sensor and a diffuse reflection type sensor, and is comprised of a light emitting element 91 comprising an LED, a regular reflection light receiving element 92 and a diffuse reflection light receiving element 93 comprising photodiodes. The light emitting element 91 is installed at an angle of 30° with respect to a direction perpendicular (normal) to the surface of the intermediate transfer belt 5, and applies infrared light to a pattern P on the intermediate transfer belt 5. The regular reflection light receiving element 92 is installed at a symmetrical position with respect to the light emitting element 91, and detects regular reflection light from the pattern P. Also, the diffuse reflection light receiving element 93 is installed in a direction perpendicular to the intermediate transfer belt 5, and detects diffuse reflection light from the pattern P.

Figure 3:
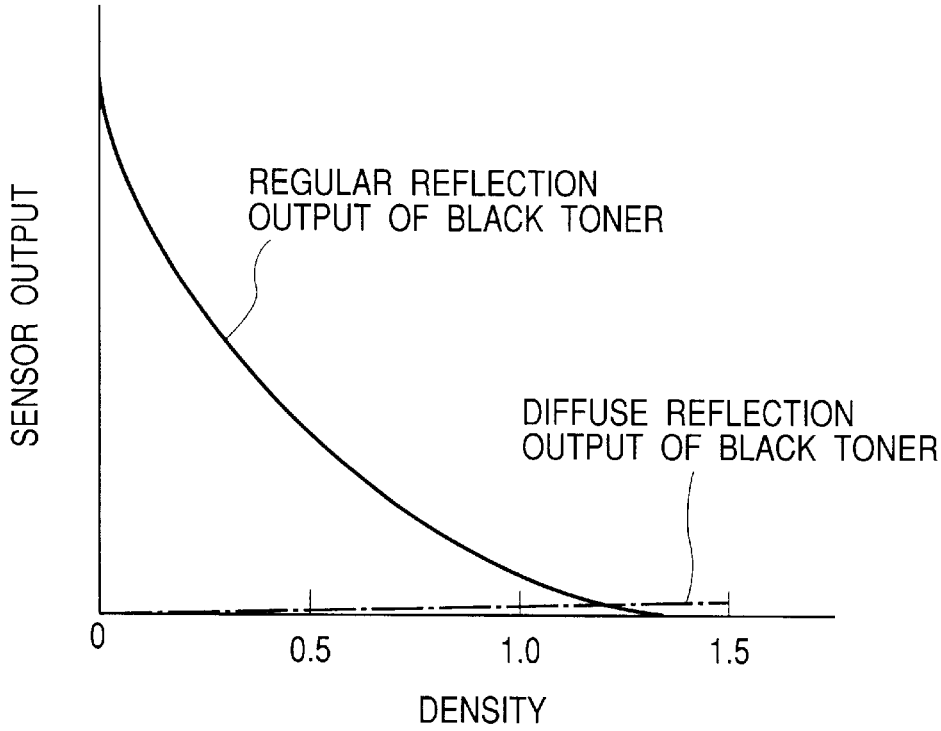
FIG. 3 is a graph showing the sensor output of a black toner in Embodiment 1 of the present invention.

FIG. 3 shows the output characteristic when a pattern by a black toner is formed on the intermediate transfer belt 5 and the reflected light by the pattern is detected by the regular reflection light receiving element 92 and the diffuse reflection light receiving element 93. In FIG. 3, the axis of ordinates indicates the sensor output value of a regular reflection component and a diffuse reflection component, and the axis of abscissas indicates the density value representing the optical density after the pattern has been transferred onto paper and fixed minus the paper density.

In the present embodiment, the intermediate transfer belt 5 comprises a single-layer resin belt made of polyimide resin, and a moderate amount of carbon fine particles is dispersed in the resin to thereby effect the resistance adjustment of the belt. Therefore, the surface color of the intermediate transfer belt 5 is black and diffuse reflection scarcely occurs. The surface of the intermediate transfer belt 5 is high in smoothness and has a glossy property, and the degree of gloss thereof is about 100% (measured by Gloss Checker IG-320 manufactured by Horiba, Ltd.).

In a state in which there is no pattern on the surface of the intermediate transfer belt 5 and the surface is exposed (toner density 0), the regular reflection light receiving element 92 detects the light, as shown in FIG. 3. The reason is that as described above, the surface of the intermediate transfer belt 5 has a glossy property. On the other hand, when a pattern of the black toner is formed on the intermediate transfer belt 5, the regular reflection output gradually decreases as indicated by solid line in FIG. 3 as the toner density of the pattern increases. This is because the regular reflection light from the surface of the belt is decreased by the toner covering the surface of the intermediate transfer belt 5.

In contrast, the detection output of the diffuse reflection light receiving element 93 exhibits a low value irrespective of the toner density, as indicated by dot-and-dash line in FIG. 3. This is because both of the intermediate transfer belt 5 and the black toner scarcely have a diffuse reflection component.

Accordingly, in the detection of the density of the pattern by the black toner, it is preferable to use a regular reflection component, and in the present embodiment as well, the toner density of the black pattern is calculated from the detection output of the regular reflection light receiving element 92.

Figure 4:
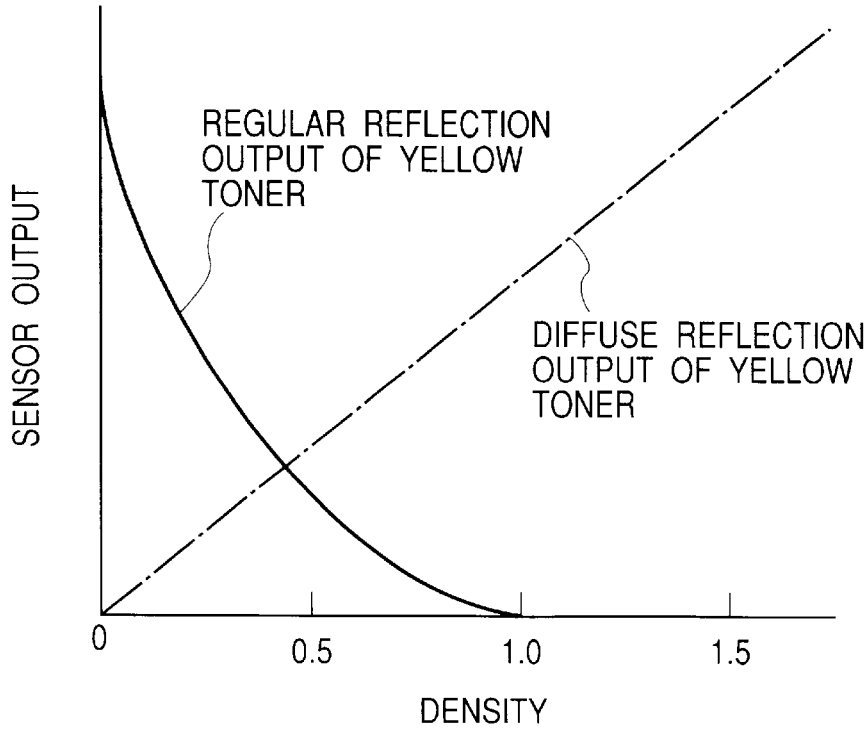
FIG. 4 is a graph showing the sensor output of a color toner in Embodiment 1.

FIG. 4 shows the output characteristic when a pattern by a yellow toner is formed on the intermediate transfer belt 5 and the reflected light by the pattern is detected by the regular reflection light receiving element 92 and the diffuse reflection light receiving element 93. In FIG. 4, the meanings of the axis of ordinates and the axis of abscissas are similar to those in FIG. 3. In FIG. 4, the output characteristic of the regular reflection light component is substantially the same characteristic in the case of the black toner (solid line in FIG. 4). That is, again in the case of the yellow toner, it is represented that the regular reflection component is chiefly the surface reflection (gloss) of the intermediate transfer belt 5.

In contrast, the detection output of the diffuse reflection light receiving element 93 rises with an increase in the toner density (dot-and-dash line in FIG. 4). Further, unlike the regular reflection component, it exhibits a good output characteristic even in a high density area.

Accordingly, in the detection of the density of the pattern by the yellow toner, it is preferable to use the diffuse reflection component and again in the present embodiment, the toner density of the yellow pattern is calculated from the detection output of the diffuse reflection light receiving element 93. The output characteristics for the toners of other colors, i.e., magenta and cyan, are substantially similar to the output characteristic for the yellow toner and accordingly, the detection output of the diffuse reflection light receiving element 93 is also used for the density detection of the patterns of the other color toners.

Description will now be made of the validity of directionality when the density sensor 9 is inclined with respect to the intermediate transfer belt 5. The inclination, as shown in FIG. 6, is represented by the mounting angle θ of the sensor formed between the normal v to the surface of the intermediate transfer belt 5 and the direction of the diffuse reflection light receiving element 93.

Figure 5:
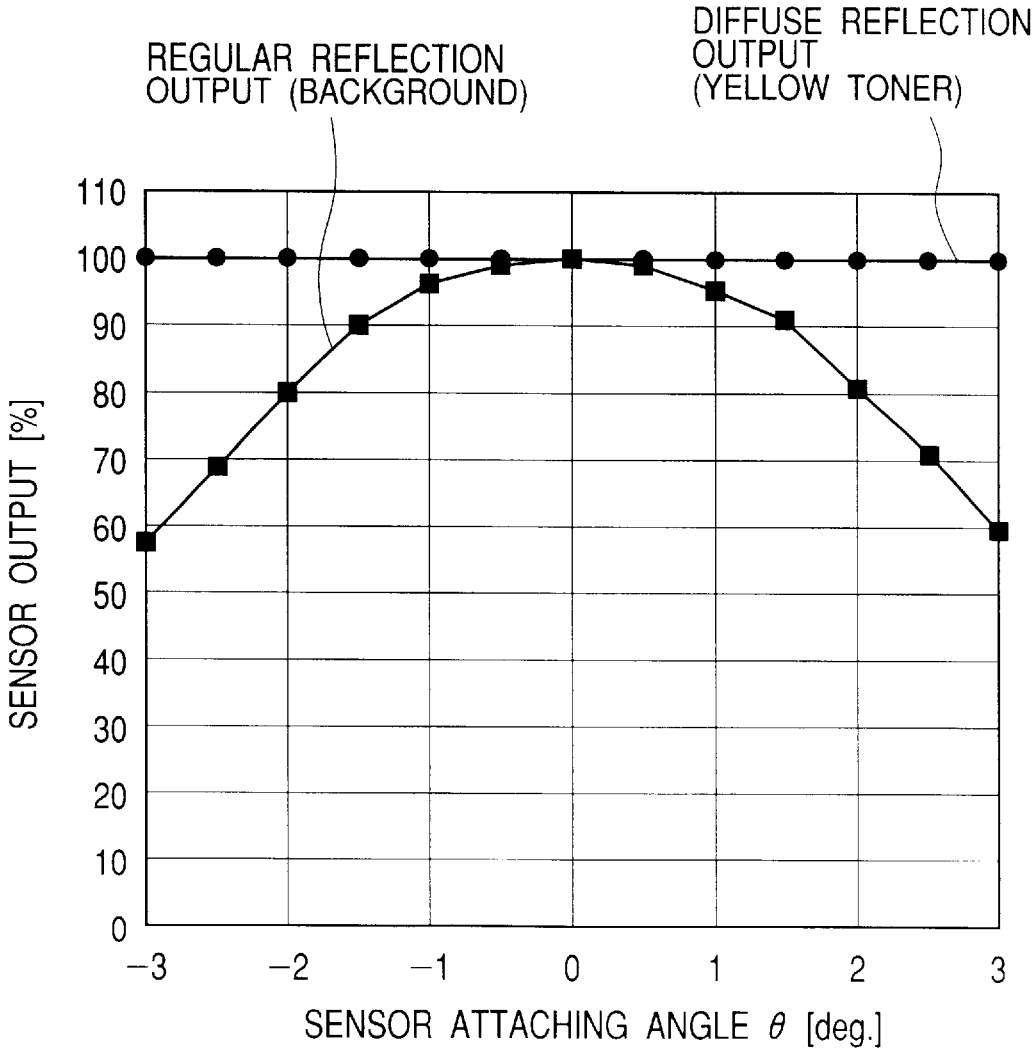
FIG. 5 shows the directionality of the regular reflection and diffuse reflection of the density sensor of FIG. 2.

FIG. 5 shows changes in the regular reflection output and the diffuse reflection output when the sensor is inclined. In FIG. 5, the axis of ordinates indicates the ratio when the light reception output when the sensor is not inclined is 100, and the axis of abscissas indicates the mounting angle θ of the sensor. The output value (background output value) of the intermediate transfer belt 5 is used as the regular reflection output, and the output value from a yellow pattern of density 1.5 is used as the diffuse reflection output.

As will be seen from FIG. 5, the regular reflection output decreases in its output value with a change in the mounting angle θ of the sensor. This is representative of the fact that the regular reflection component has a strong directionality characteristic. On the other hand, the diffuse reflection component is constant in its output value irrespective of the mounting angle θ, and this is representative of the fact that it has little or no directionality.

Figure 6:
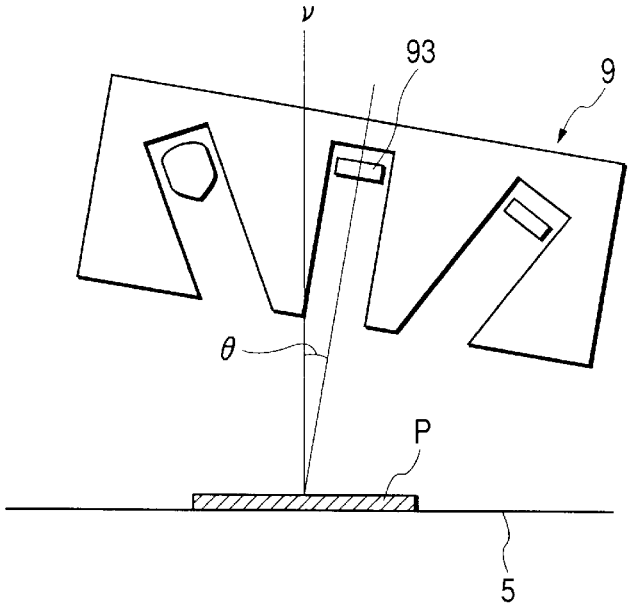
FIG. 6 shows the density sensor of FIG. 2 when the density sensor is inclined.

The deviation of the mounted position of the sensor occurs due to not only the lateral inclination shown in FIG. 6, but also, for example, the fluctuation of the distance between the intermediate transfer belt 5 and the density sensor 9, or the longitudinal inclination or the like, but in any case, a characteristic resembling the characteristic shown in FIG. 5 is brought about by the difference between the directionality characteristics of the regular reflection component and the diffuse reflection component. That is, when the mounted position of the density sensor 9 fluctuates, the light reception output of the regular reflection light receiving element 92 decreases, but the light reception output of the diffuse reflection light receiving element 93 does not change.

The correction of the diffuse reflection light output which is a great feature of the present invention will now be described with reference to FIG. 7. The correction is used for the detection of the density of the color toners. The correction is effected by the same method for all of the yellow, magenta and cyan color toners and therefore, here, description will be made with the detection of the density of the yellow toner taken as an example.

Figure 7:
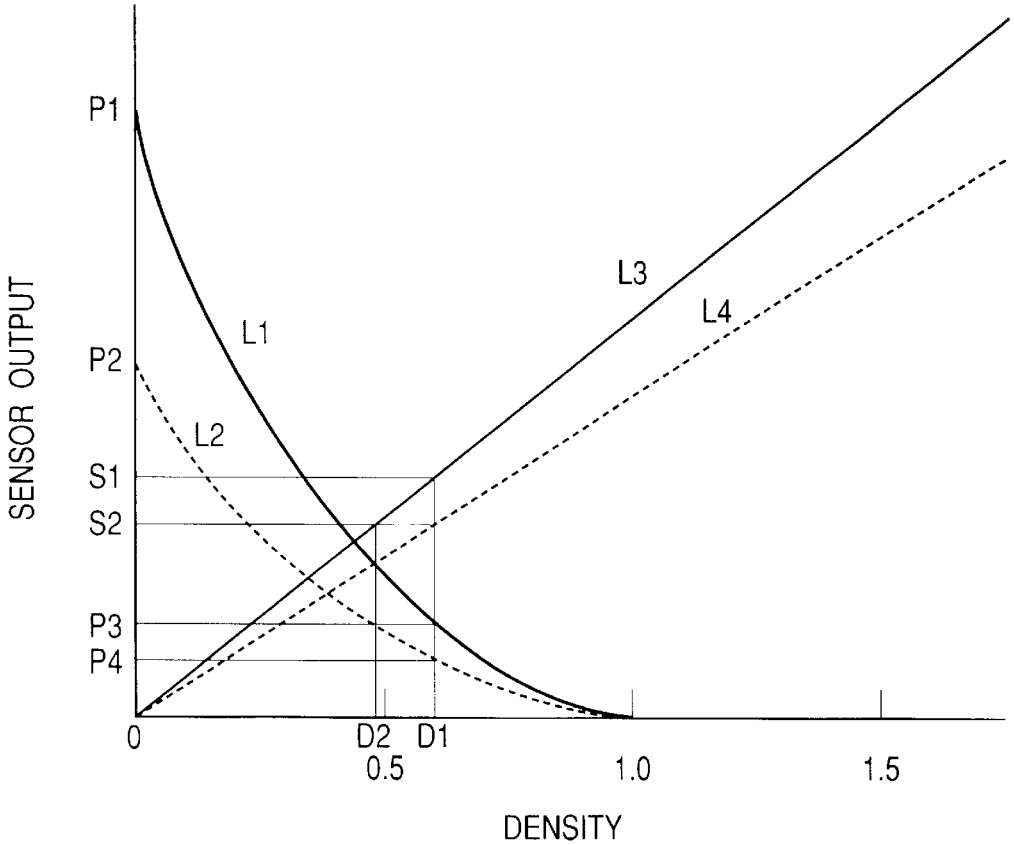
FIG. 7 shows a correcting method for the diffuse reflection output by Embodiment 1.

FIG. 7 will first be described. In FIG. 7, L1 indicated by solid line is representative of the regular reflection output characteristic in a default state in which there are not the fluctuation factors (such as the fluctuation of the quantity of emitted light, the fluctuation of the gloss of the intermediate transfer belt 5 and the deviation of the mounted position of the density sensor 9) of the sensor output characteristic, and L3 is representative of the diffuse reflection output characteristic in the same state. These characteristics L1 and L3 (the relation between the density and the sensor output value) are stored in advance as a conversion table in the memory of the main body of the apparatus. The form in which the characteristics L1 and L3 are stored may also be the form of a conversion expression, and an optimum method can be selected in conformity with the capacity or calculation speed of the memory of the main body.

In FIG. 7, L2 and L4 indicated by broken lines are representative of the regular reflection output characteristic (L2) when there is a fluctuation in the sensor output characteristic, and the diffuse reflection output characteristic (L4) in the same case. In the present embodiment, a case where the quantity of emitted light of the light emitting element 91 has decreased to 80% relative to the initial value (the default value indicated by L1 and L3) and the mounting angle θ of the sensor has been inclined by 2° is mentioned as an example. In the case, the light reception output of the diffuses reflection light is subjected to the influence of only the fluctuation of the quantity of light of the light emitting element and therefore, the output value decreases to 80% (for example, in FIG. 7, S2 is 0.8 time relative to S1).

On the other hand, the regular reflection light reception output is subjected to the influence of the inclination of the sensor, in addition to the fluctuation of the quantity of light of the light emitting element. The output variable ratio when the sensor is inclined by 2° is about 0.8 time from FIG. 5 and accordingly, in the present embodiment, the variable ratio of the regular reflection output is 0.8×0.8=0.64 (for example, in FIG. 7, P2 is 0.64 time relative to P1). It is a great feature of the present invention that even when the variable ratios of the regular reflection output and the diffuse reflection output differ from each other as described above, the correction of the diffuse reflection output can be effected.

Figure 8:
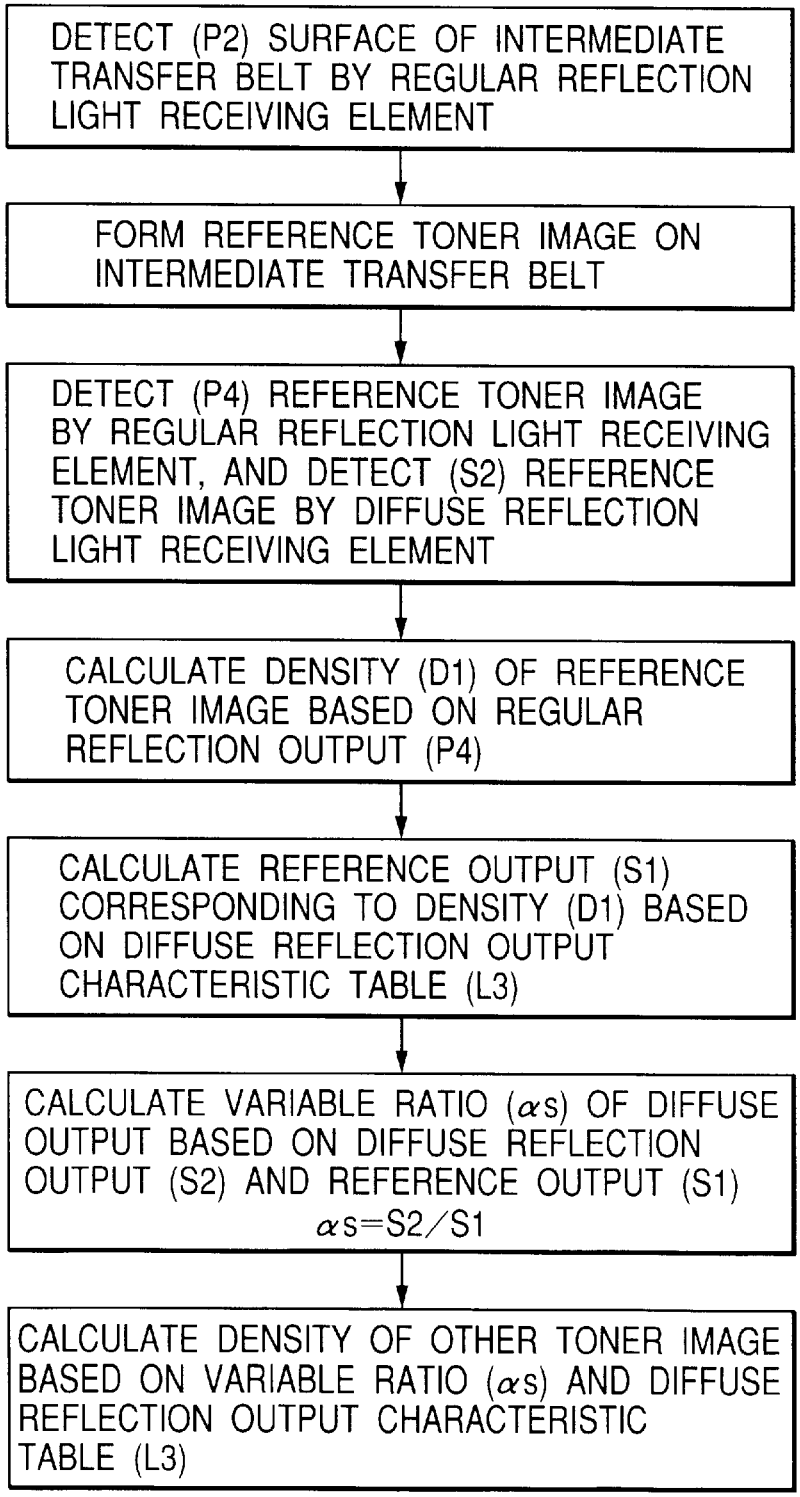
FIG. 8 is a flowchart showing the correcting method for the diffuse reflection output by Embodiment 1.

The procedure of correcting the diffuse reflection light output by the present invention will hereinafter be described with reference to FIGS. 8 and 9. First, the surface of the intermediate transfer belt 5 is detected by the regular reflection light receiving element 92. The detection value at the time is P2 (background output). Next, a reference toner image is formed on the intermediate transfer belt 5. Here, the reference toner image need not always be constant in density, but it is important that it is a pattern from which both of the diffuse reflection output and the regular reflection output are sufficiently put out. In the present embodiment, a halftone dither image of an image percentage 33% was used as the reference toner image. In the color image forming apparatus used in the present embodiment, the image density of the above-mentioned halftone dither image of 33% is generally within a range of 0.3 to 0.7, and in the present embodiment, was 0.6 (D1 in FIG. 7). As a matter of course, the pattern or halftone percentage of the reference toner image is not restricted thereto, but an optimum pattern can be selected in accordance with an image forming apparatus using the present invention.

Next, the output value from the aforementioned reference toner image is detected by the regular reflection light receiving element 92 and the diffuse reflection light receiving element 93. The regular reflection output and the diffuse reflection output are P4 and S2, respectively, in FIG. 7.

Next, the density D1 of the reference toner image is calculated on the basis of the regular reflection output. In the case of the regular reflection output, the calculation of the toner density is possible by the correction by generally known normalization (a similar correcting method is disclosed in Japanese Patent Application Laid-Open No. 12-258966, and so on.), and the method will hereinafter be described.

First, from a measured background output P2 and a predetermined reference background output P1, the variable ratio αp of the regular reflection output is calculated on the basis of $$\alpha p = P2/P1.$$

Next, the output value P4 of the reference toner image is normalized by the variable ratio up, and the output P3 after corrected is calculated on the basis of $$P3 = P4/\alpha p.$$

By referring to the regular reflection output characteristic table (L1), the density D1 of the reference toner image is calculated from the calculated output 3 after corrected.

Next, by referring to the diffuse reflection output characteristic table (L3), a reference output S1 for the density D1 is calculated.

From the diffuse reflection output value S2 actually obtained from the reference toner image and the reference output S1 for the density D1, the variable ratio αs of the diffuse reflection output is calculated on the basis of $$\alpha s = S2/S1.$$

Figure 9:
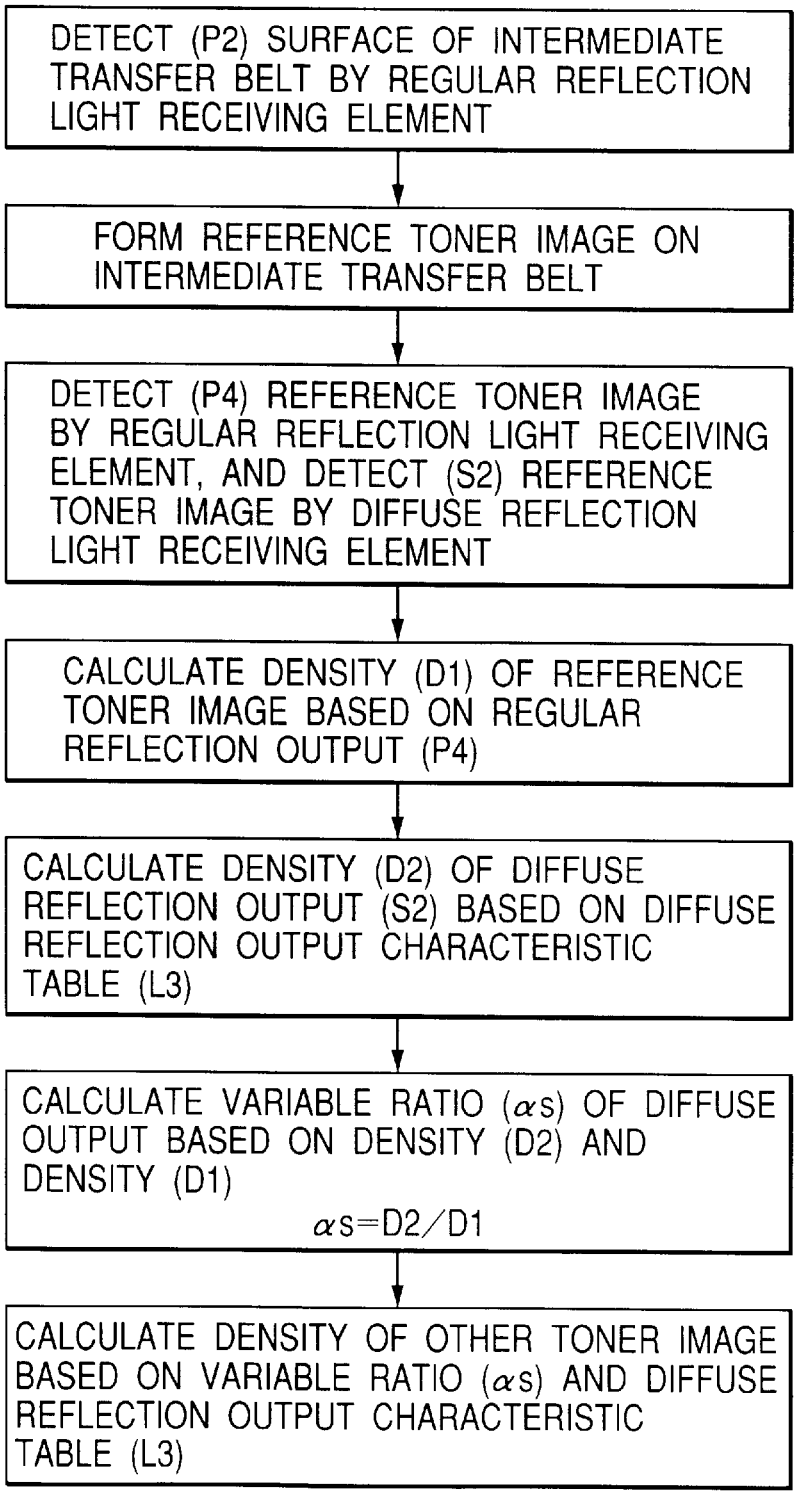
FIG. 9 is a flowchart showing a modification of the correcting method for the diffusion reflection output by Embodiment 1.

When as in the present embodiment, the relation between the diffuse reflection output and the toner density is linear, as shown in FIG. 9, the diffuse reflection output S2 of the reference toner image may be directly referred to by the use of the diffuse reflection output characteristic table L3, and the variable ratio αs may be calculated from the output density at that time. In this case, αs is $$\alpha s = D2/D1.$$

Since the variable ratio αs of the diffuse reflection output can be found by the above-described procedure, the density of the other toner images (the toner images used in image density control) can be calculated if the characteristic table (L3) of the diffuse reflection output is referred to after the diffuse reflection output value from the toner images has been normalized by αs.

The method of correcting the diffuse reflection output in the present embodiment has been described above. The feature of the correction is that in such a density area that the regular reflection output and the diffuse reflection output are both obtained (in the present embodiment, an area of density 1.0 or less), the density for the reference toner image is detected by the use of a regular reflection light receiving element excellent in detection accuracy, and the diffuse reflection light reception output is corrected by the use of that detected density value to thereby improve the accuracy of the density detection by the diffuse reflection output. Further, by effecting density detection by the diffuse reflection output, accurate density detection becomes possible even in a high-density area (in the present embodiment, density 1.0 or higher) of which the density was undetectable by the regular reflection output.

The image density control in the color image forming apparatus of the present embodiment will now be described in detail. The image density control is effected in the order of yellow, cyan, magenta and black, and the image density control of the yellow image effected at first will hereinafter be described.

Figure 10:
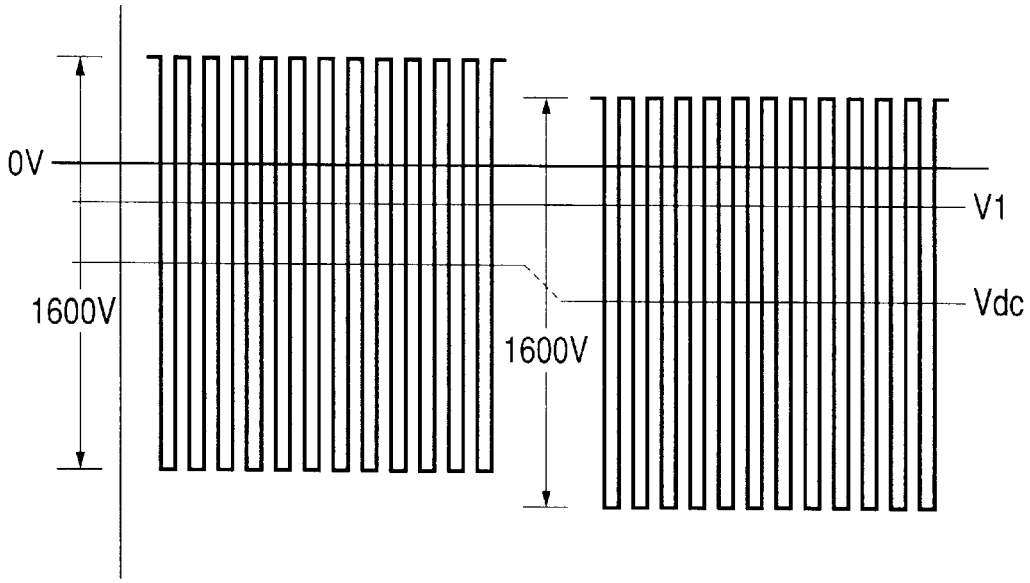
FIG. 10 shows a developing bias used in the image forming apparatus of FIG. 1.

First, the photosensitive drum 1 is charged by the charging roller 2 so that the surface potential thereof may be −600V. Here, the sensitivity of the photosensitive drum and the exposure amount of the laser are adjusted in advance so that the potential (V1) of the portion exposed to the laser beam may be about −200V at a normal temperature and normal humidity (23° C., 60% Rh). As the developing bias, use is made of one comprising a rectangular wave (frequency 2000 Hz, voltage 1600 Vpp) superimposed on a DC voltage, as shown in FIG. 10, and by the DC voltage component Vdc being varied, the developing amount of the toner is controlled.

Figure 11:
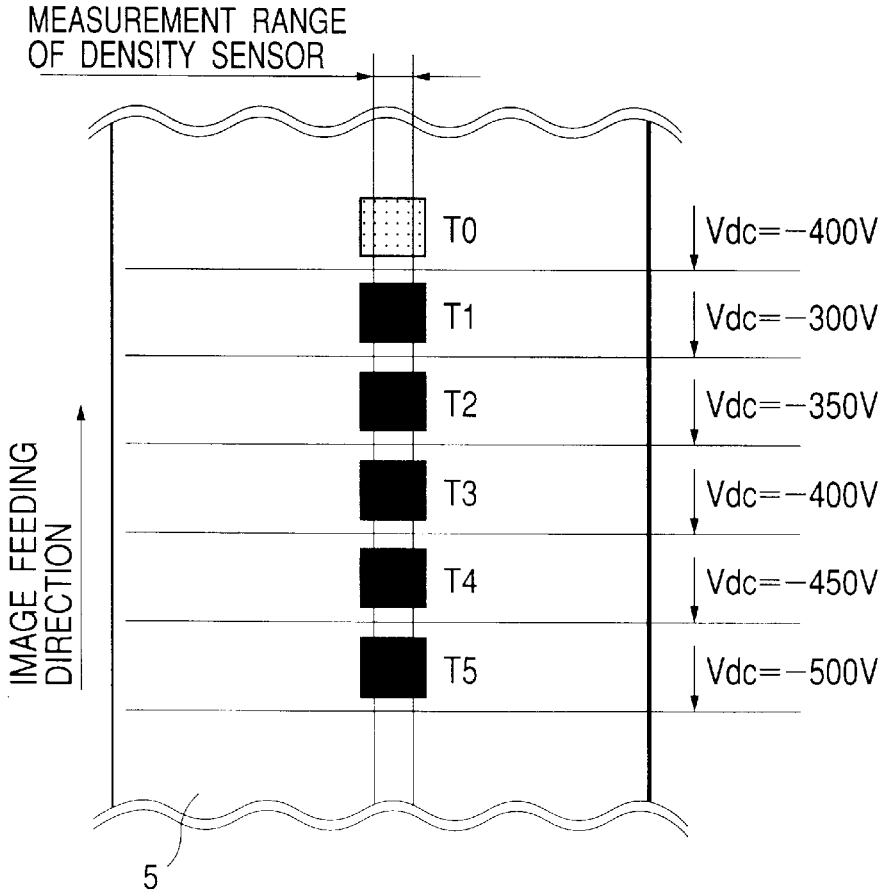
FIG. 11 shows a toner image for control formed by the image forming apparatus of FIG. 1.

A toner pattern for image density control is formed on the photosensitive drum 1 which is the first image bearing member, and thereafter is transferred to the intermediate transfer belt 5 which is the second image bearing member. FIG. 11 shows the toner pattern for image density control on the intermediate transfer belt 5, and six pattern images of 30 mm square T0, T1, T2, T3, T4 and T5 are formed at intervals on the portion on which the density sensor 9 is installed. Among these, the toner pattern T0 is a halftone pattern (reference toner image) used for the aforedescribed correction of the diffuse reflection output, and the toner patterns T1 to T5 are solid image patterns used for the control of the image forming condition (developing bias).

Here, the reference toner image T0 is developed by −400V which is the standard Vdc, and the patterns T1 to T5 are developed by developing biases of different DC voltage components. In the present embodiment, the DC component Vdc of the developing biases corresponding to T1 to T5 was varied at the intervals of 50V from −300V to −500V.

The density of the toner patterns T1 to T5 is calculated from the diffuse reflection output value, but prior thereto, the calculation of the correction coefficient of the aforedescribed diffuse reflection output (the variable ratio as of the diffuse reflection) is effected by the use of the toner pattern T0. The regular reflection output value of the intermediate transfer belt 5 used during the calculation of the correction coefficient is measured before the toner patterns are formed.

Figure 12:
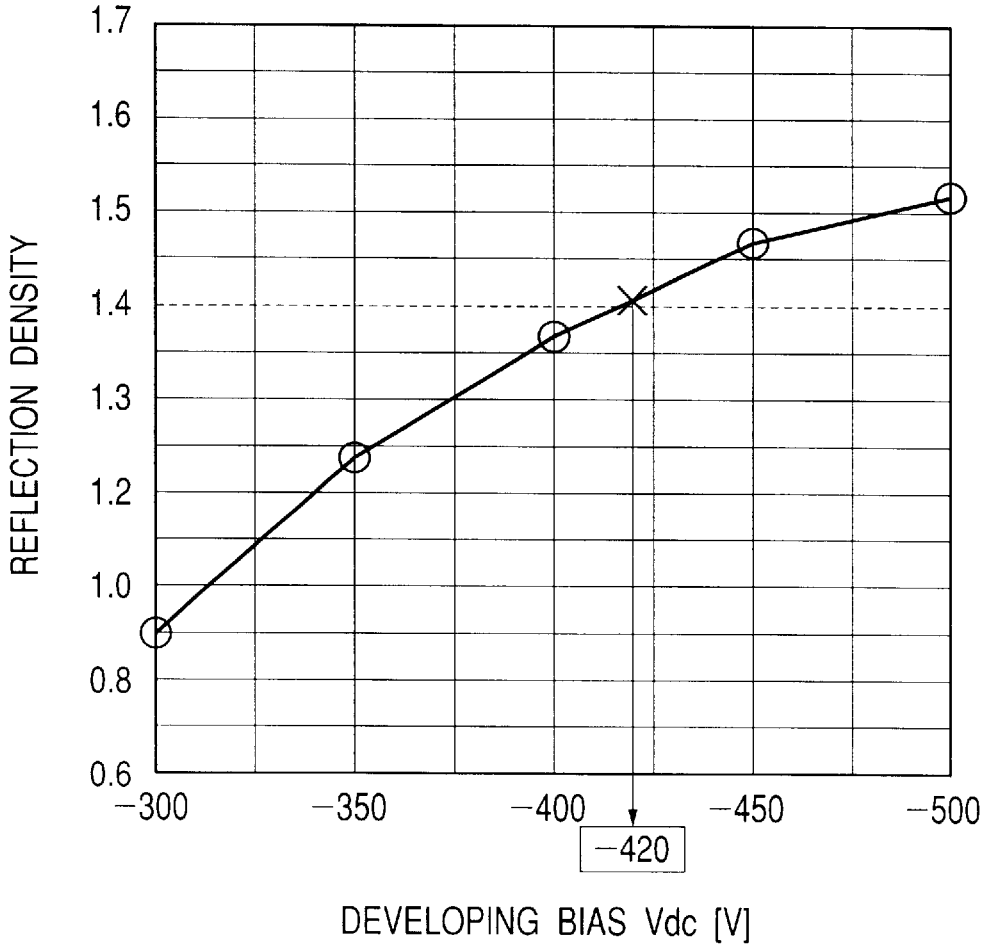
FIG. 12 shows a density controlling method carried out in Embodiment 1.

An example of the result of the measurement of the density of the toner patterns T1 to T5 is shown in FIG. 12. In the example, the density target value (proper density value) of the solid image is 1.4, and control is effected so that the image formation thereafter may be effected under a developing condition (in the present example, the DC voltage component of the developing bias) presumed to be most approximate thereto. In the present example, there were obtained the reflection density data of five points indicated by circular marks in FIG. 12.

The developing condition under which the reflection density is 1.4 is between −400V and −450V of the DC component Vdc, and assuming that in the section, the DC component and the reflection density are in an approximately proportional relation, it is found that the reflection density becomes 1.4 when the DC component is about −420V as the interior division can be obtained on the basis of the reflection densities at −400V and −450V of the DC component. Accordingly, in the present example, as the subsequent image forming condition, the DC component Vdc of the developing bias for the yellow image formation is controlled to −420V.

The control as described above is also executed for magenta and cyan, whereby the image density control of the color toners is completed.

Next, the density control of the black toner was effected without the use of the reference toner image T0 and with the toner images T1 to T5 for image forming condition control being made into halftone patterns of a coverage rate of 50% and further, with the target density of control (proper density value) being 0.8.

The reason is that the density detection of the black toner uses the regular reflection output and is therefore bad in the detection accuracy of a high-density area and a solid image pattern cannot be used as for the color toners. Also, the correction of the diffuse reflection output is not effected and therefore, the reference toner image T0 is unnecessary. It is a popular technique to use a halftone pattern for the density control of the black toner, and in the case of a black image, it is important to make the width of the character of a text proper and therefore, it may also be said that it is more preferable to control halftone density than solid density.

By the above-described density control, it becomes possible to obtain proper density for all of the color toner images and the black toner image.

The above-described image density control is executed prior to image formation (printing) each time a predetermined number of sheets are printed, when the power supply switch of the main body of the apparatus is closed, and when the photosensitive drum 1 or the developing device 4 (4*a* to 4*d*) is interchanged, and when the apparatus receives a printing command in a state in which it is not used for a long time.

Further, when the fluctuation factor of the image density is great and cannot be coped with by the developing bias alone, other image forming condition such as the charging condition or the exposing condition (exposure amount) can also be combined therewith and controlled.

For example, when the density characteristic of a halftone (generally a halftone γ characteristic) in a state in which solid density is adjusted is uneven, it is necessary to adjust the exposing condition, etc. and correct the halftone density. When effecting the halftone density correction, it is also necessary to detect the toner image density of the halftone, and the correction of the diffuse reflection output described in the present embodiment can be applied.

While in the foregoing, a toner pattern for density detection is formed on the photosensitive drum 1 which is the first image bearing member and the toner pattern is transferred to the intermediate transfer belt 5 which is the second image bearing member, and about the toner pattern on the intermediate transfer belt 5, the toner image density thereof is detected by the diffuse reflection type and regular reflection type density detecting sensors, the toner image density of the toner pattern for density detection can also be detected on the photosensitive drum 1.

As described above, according to the present embodiment, design is made such that when a toner image for density detection is formed on the image bearing member such as the photosensitive drum or the intermediate transfer member and the density of the toner image is detected by the diffuse reflection type and regular reflection type density detecting sensors and the image forming conditions are controlled on the basis of the result of the detection, a reference toner image of a color toner is formed on the image bearing member and reflected light from the reference toner image is detected by the diffuse reflection type and regular reflection type density detecting sensors, and the correction of the output value of the diffuse reflection type density detecting sensor is effected on the basis of the output value of the regular reflection type density detecting sensor at that time, and therefore the density detection accuracy of the color toners is improved and as the result, it has become possible to provide a color image forming apparatus which is low in cost and excellent in the stability of color reproduction.

Also, the diffuse reflection output is used for the density detection of the color toners and therefore, as compared with a method of detecting density by the regular reflection output, the detection accuracy of a high-density area can be improved. Specifically, the color toner density detectable by the regular reflection output was about 1.0 or less, but by effecting density detection by the use of the diffuse reflection light, the detection of the toner density becomes possible even in areas of density 1.0 or greater (see FIG. 4). Further, the excessive bearing of the toners in high-density areas of the color toners can be suppressed and therefore, it is possible to prevent various evils such as bad transfer and bad fixing which occur when the toner bearing amount is great.

Embodiment 2

In the second embodiment, description will be made of a correcting method for the diffuse reflection output with respect to a case where the image bearing member on which a toner image for detection is formed, i.e., the intermediate transfer member in the present embodiment, is other color than black.

Specifically, for example, a reference toner image of a color toner is formed on the intermediate transfer member, and reflected light from the reference toner image is detected by the diffuse reflection type and regular reflection type density detecting sensors, and on the basis of the output value of the regular reflection type density detecting sensor and the output value of the diffuse reflection type density detecting sensor at that time and further, the detection output value obtained by detecting the surface of the intermediate transfer member by the diffuse reflection type density detecting sensor, the correction of the output value of the diffuse reflection type density detecting sensor is effected.

The main construction and image density controlling method of a color image forming apparatus used in the present embodiment are similar to those in Embodiment 1 and need not be described in detail.

In the present embodiment, the intermediate transfer belt 5 is a single-layer resin belt made of polyimide resin, and has a suitable amount of titanium oxide fine particles dispersed in the resin for the adjustment of the resistance of the belt. Accordingly, the surface color of the intermediate transfer belt 5 is gray, and the belt itself has a diffuse reflection component. The surface of the intermediate transfer belt 5 is high in smoothness and has a glossy property, and the degree of gloss thereof is about 100% (measured by a Gloss Checker IG-320 manufactured by Horiba Ltd.).

Figure 13:
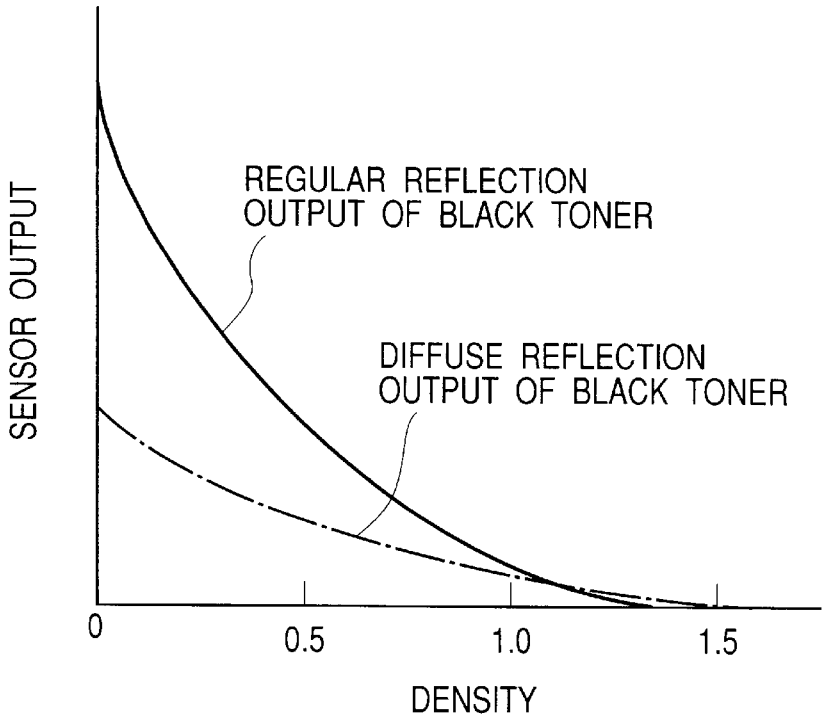
FIG. 13 is a graph showing the sensor output of the black toner in Embodiment 2 of the present invention.

FIG. 13 is a graph showing the output characteristic when a black toner image is formed on the intermediate transfer belt 5 used in the present embodiment and reflected light is detected by the regular reflection light receiving element 92 and the diffuse reflection light receiving element 93. In FIG. 13, the axis of ordinates indicates the output values of a regular reflection component and a diffuse reflection component, and the axis of abscissas indicates a density value representative of the optical density after the toner image has been transferred onto paper and fixed, minus paper density.

In FIG. 13, when in a state in which there is no toner on the surface of the intermediate transfer belt 5 and the surface is exposed (toner density is 0), the regular reflection light receiving element 92 detects reflected light. The reason is that as previously described, the surface of the intermediate transfer belt 5 has a glossy property. When a black toner image is formed on the intermediate transfer belt 5, as the density of the toner image increases, the regular reflection output gradually decreases as indicated by solid line in FIG. 13. This is because the toner covers the surface of the intermediate transfer belt 5, whereby the regular reflection light from the surface of the belt is decreased.

On the other hand, the detection output of the diffuse reflection light receiving element 93 also detects the light when the surface of the intermediate transfer belt 5 is in its exposed state (toner density is 0). The reason is that the intermediate transfer belt 5 used in the present embodiment is gray and therefore has a diffuse reflection property. When a black toner image is formed on the intermediate transfer belt 5, as the density of the toner image increases, the diffuse reflection output gradually decreases as indicated by dot-and-dash line in FIG. 13. This is because the toner covers the surface of the intermediate transfer belt 5, whereby the diffuse reflection light from the surface of the belt is decreased.

In the case, in the detection of the density of the black toner, either of the regular reflection component and the diffuse reflection component may be used, but in the present embodiment, as in Embodiment 1, the toner density is calculated from the detection output of the regular reflection light receiving element 92. The reason is that generally the quantity of regular reflection light reception becomes greater than the quantity of diffuse reflection light reception and is therefore difficult to be affected by noise, and detection accuracy becomes higher.

Figure 14:
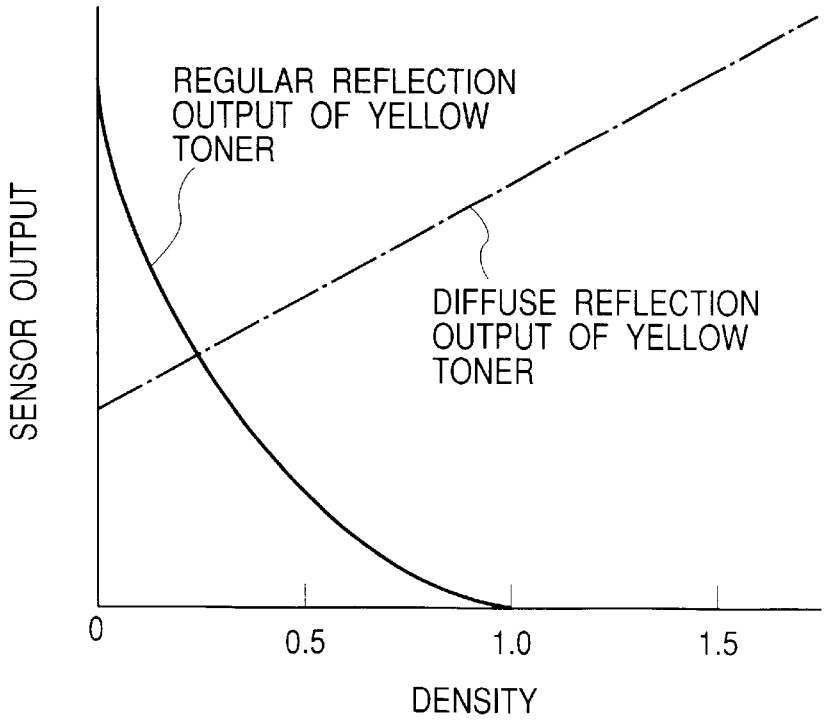
FIG. 14 is a graph showing the sensor output of a color toner in Embodiment 2.

FIG. 14 is a graph showing the output characteristic when a yellow toner image is formed on the intermediate transfer belt 5 and reflected light is detected by the regular reflection light receiving element 92 and the diffuse reflection light receiving element 93 (the meanings of the axis of ordinates and the axis of abscissas in FIG. 14 are similar to those in FIG. 13). In FIG. 14, the output characteristic of the regular reflection light component (solid line in FIG. 14) exhibits substantially the same characteristic as that in the case of the black toner. That is, again in the case of the yellow toner, it is represented that the regular reflection component is chiefly the surface reflection (gloss) of the intermediate transfer belt 5.

In contrast, the detection output of the diffuse reflection light receiving element 93 detects reflected light when the surface of the intermediate transfer belt 5 is in its exposed state (toner density is 0), and thus, with an increase in the toner density, the diffuse reflection output rises as indicated by dot-and-dash line in FIG. 14. Further, unlike the regular reflection component, the diffuse reflection component exhibits a good output characteristic even in a high-density area.

Accordingly, in the detection of the density of the yellow toner, it is preferable to use the diffuse reflection component, and again in the present embodiment, the toner density is calculated from the detection output of the diffuse reflection light receiving element 93. The output characteristics of the other color toners (magenta toner and cyan toner) are also substantially similar to the output characteristic of the yellow toner and accordingly, the detection output of the diffuse reflection light receiving element 93 is also used in the detection of the density of the other color toners.

The correction of the diffuse reflection light output which is a feature of the present invention will now be described with reference to FIG. 15. The correction is used in the detection of the density of the color toners, but the correction is effected by the same method for all of the yellow, magenta and cyan toners and therefore, description will be made here with the detection of the density of the yellow toner taken as an example.

Figure 15:
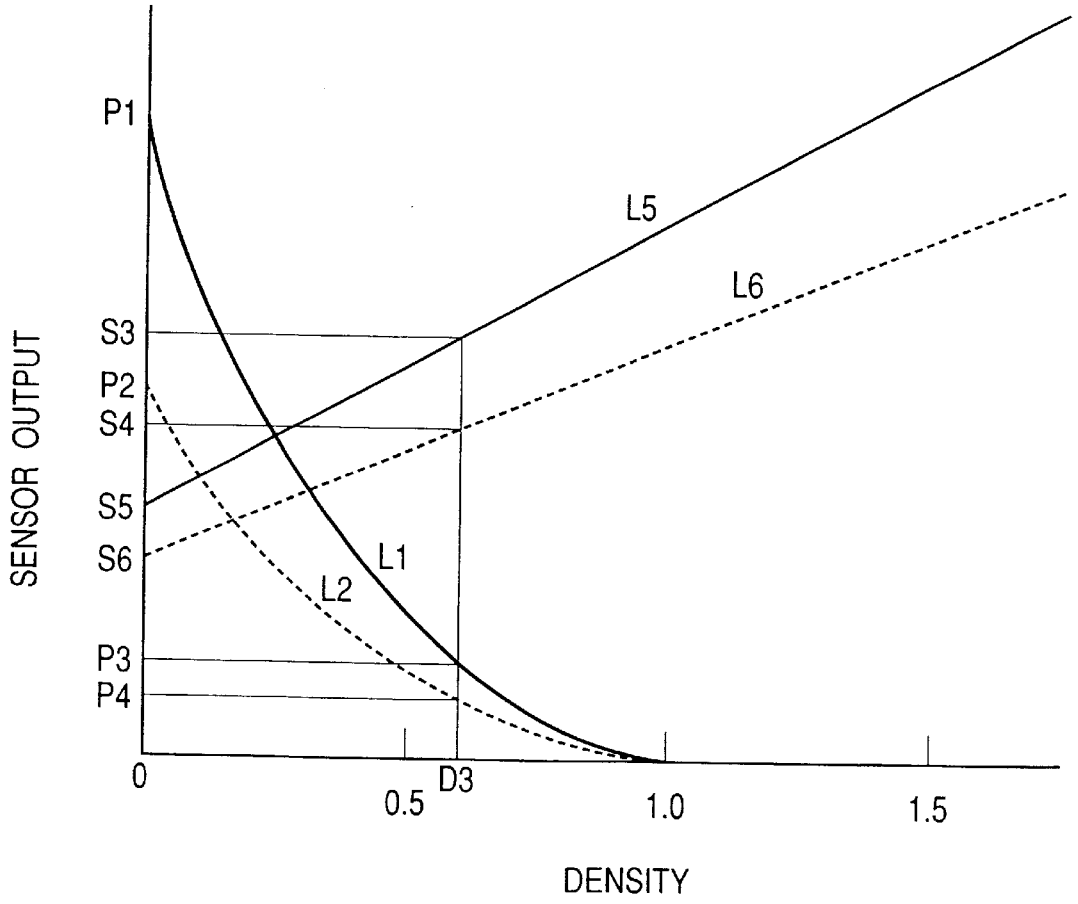
FIG. 15 shows a correcting method for the diffuse reflection output by Embodiment 2.

In FIG. 15, L1 indicated by solid line is representative of the regular reflection output characteristic in a default state in which there is no fluctuation factor of the sensor output characteristic, and L5 is representative of the diffuse reflection output characteristic in the same state. Also, the characteristics L1 and L5 (the relation between the density and the sensor output value) are stored in advance as a conversion table in the memory of the main body of the apparatus.

In FIG. 15, L2 and L6 indicated by broken lines are representative of the regular reflection output characteristic (L2) and the diffuse reflection output characteristic (L6) when there is a fluctuation in the sensor output characteristic. Again in the present embodiment, as in Embodiment 1, the case where the quantity of emitted light of the light emitting element 91 has decreased to 80% relative to its initial value and the mounting angle θ of the sensor is inclined by 2° is taken as an example.

Figure 16:
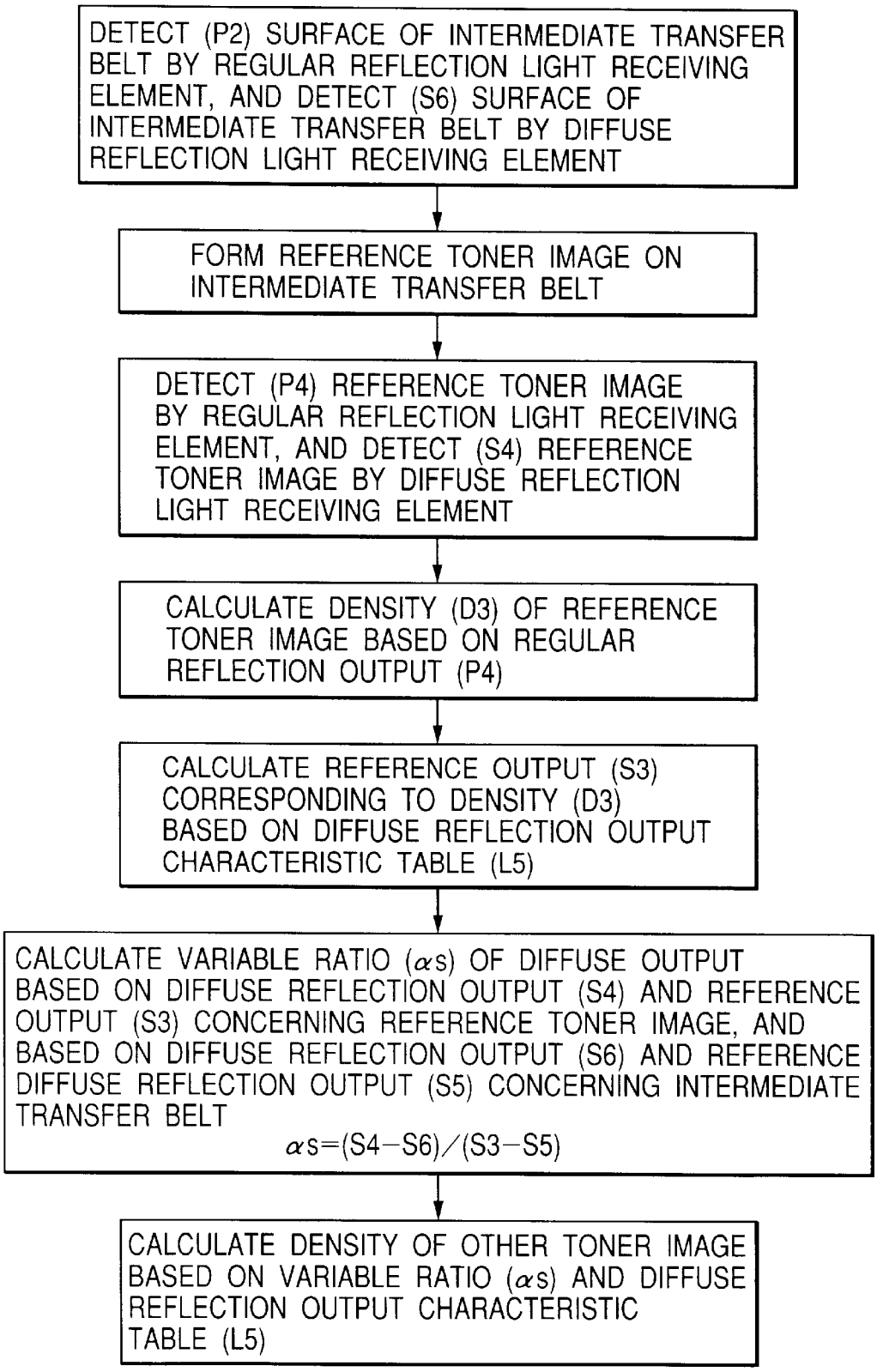
FIG. 16 is a flowchart showing the correcting method for the diffuse reflection output by Embodiment 2.

The procedure of correcting the diffuse reflection light output will hereinafter be described with reference to FIG. 16. First, the surface output of the intermediate transfer belt 5 is detected by the regular reflection light receiving element 92 and the diffuse reflection light receiving element 93. The detected values at this time are P2 and S6. Next, a reference toner image is formed on the intermediate transfer belt 5. As the reference toner image, as in Embodiment 1, use is made of a halftone dither image of an image percentage 33%. Again in the present embodiment, the density of the reference toner image was 0.6 (D3 in FIG. 15).

Next, the output value from the aforementioned reference toner image is detected by the regular reflection light receiving element 92 and the diffuse reflection light receiving element 93. The regular reflection output and the diffuse reflection output are P4 and S4, respectively, in FIG. 15. Next, the density D3 of the reference toner image is calculated on the basis of the regular reflection output using a method similar to that described in Embodiment 1.

First, from a measured background output P2 and a predetermined reference background output P1, the variable ratio αP of the regular reflection output is calculated on the basis of $$\alpha P = P2/P1.$$

Next, the output value P4 of the reference toner image is normalized by the variable ratio αP, and the output P3 after correction is calculated on the basis of $$P3 = P4/\alpha P.$$

By referring to the regular reflection output characteristic table (L1), the density D3 of the reference toner image is calculated from the calculated output P3 after correction.

Next, a reference output S3 corresponding to the density D3 is calculated with reference to the diffuse reflection output characteristic table (L5).

From the diffuse reflection output value S4 actually obtained from the reference toner image, the reference output S3 corresponding to the density D3, the diffuse reflection output S6 when the intermediate transfer belt was measured, and a reference diffuse reflection output S5 concerning the intermediate transfer belt, the variable ratio as of the diffuse reflection output is calculated on the basis of $$\alpha s = (S4 - S6)/(S3 - S5).$$

By the above-described procedure, the variable ratio αs of the diffuse reflection output is formed.

The density of the other toner images (toner images used in image density control) can be calculated if the characteristic table (L5) of the diffuse reflection output is referred to after the diffuse reflection output value from the toner image is normalized by αs.

Specifically, when the diffuse reflection output from the toner image is X0, the output X1 after normalized is $$X1 = S5 + (X0 - S6)/\alpha s,$$

and a value obtained by referring to the characteristic table (L5) for X1 is the toner density.

As described above, according to the present embodiment, design is made such that a reference toner image of a color toner is formed on the image bearing member such as the photosensitive drum or the intermediate transfer member, and the reflected light from the reference toner image is detected by the diffuse reflection type and regular reflection type density detecting sensors, and on the basis of the output value of the regular reflection type density detecting sensor and the output value of the diffuse reflection type density detecting sensor at that time and further, the detection output value obtained by detecting the surface of the image bearing member by the diffuse reflection type density detecting sensor, the correction of the output value of the diffuse reflection type density detecting sensor is effected and therefore, even if the image bearing member is of other color than black, it has become possible to improve the density detection accuracy of the color toners.

Embodiment 3

In the third embodiment, a correcting method for the diffuse reflection output when the relation between the diffuse reflection output and the toner density is not linear will be described with reference to FIG. 17.

Figure 17:
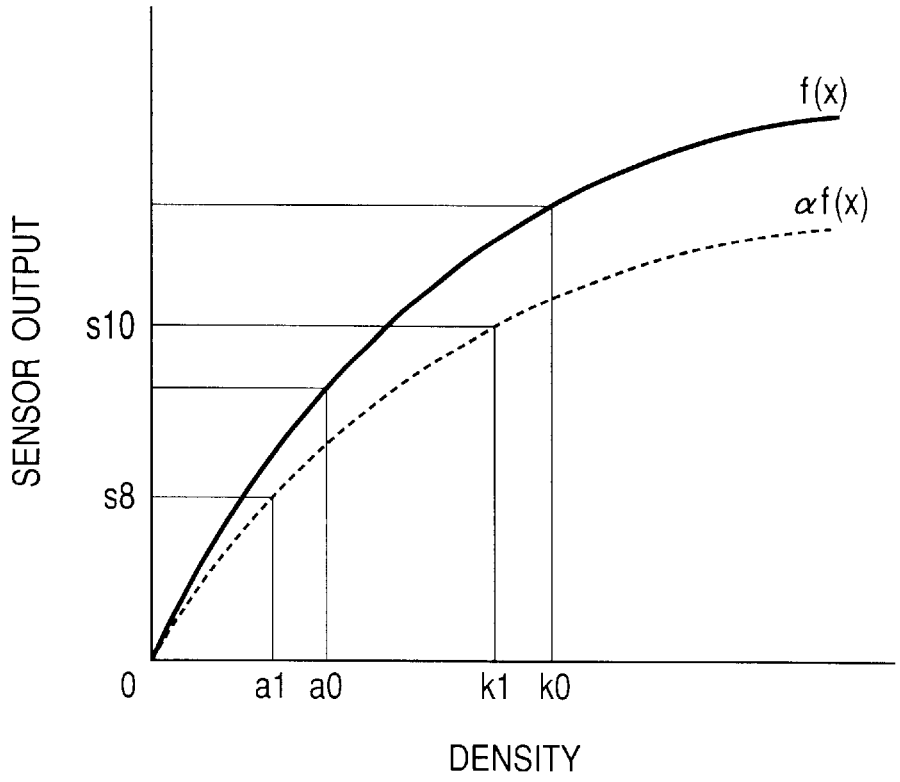
FIG. 17 shows a correcting method for the diffuse reflection output by Embodiment 3 of the present invention.
Figure 18:
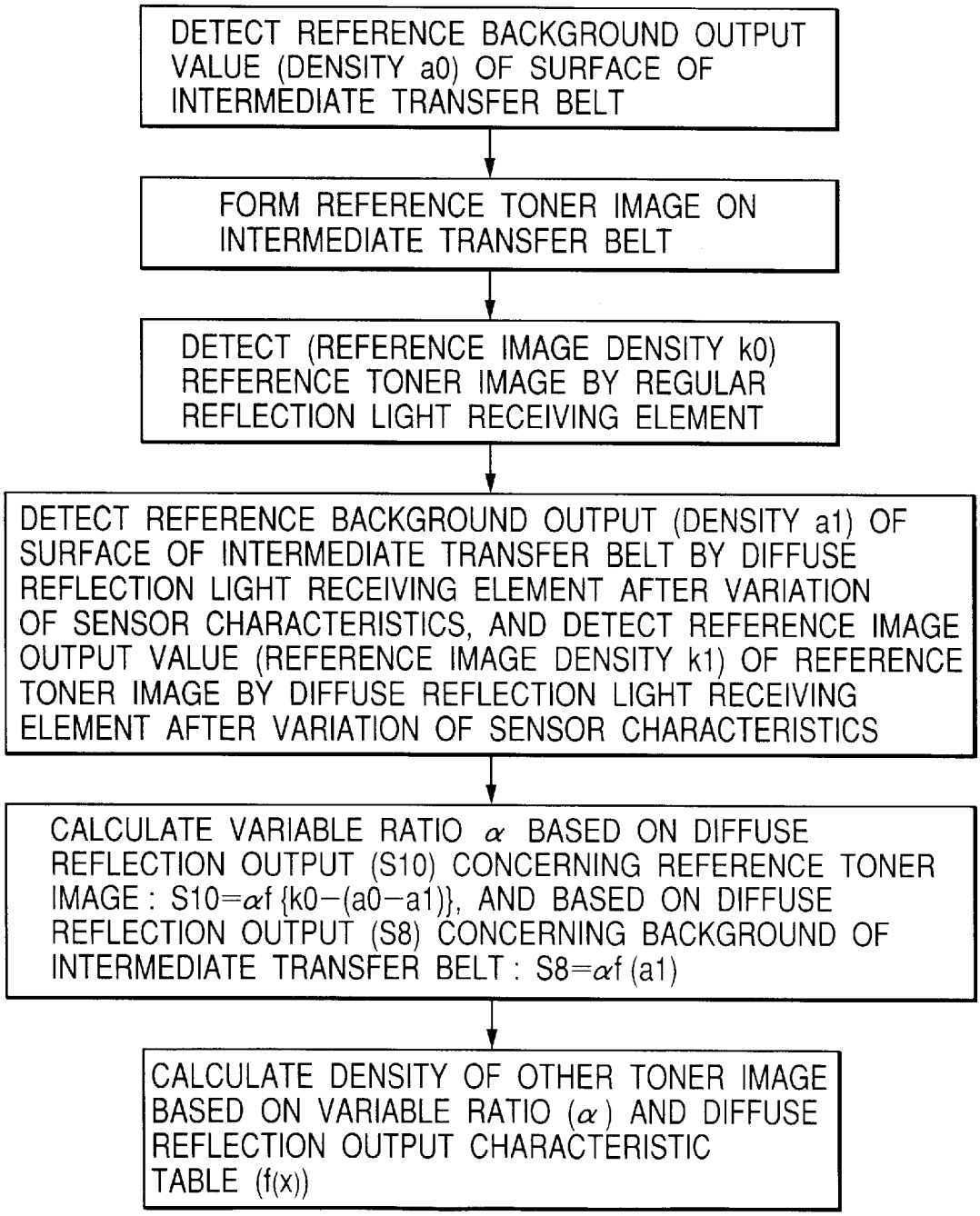
FIG. 18 is a flowchart showing the correcting method for the diffuse reflection output by Embodiment 3.

In FIG. 17, the axis of ordinates represents the diffuse reflection light reception output, and the axis of abscissas represents a value of a sum of the density of the intermediate transfer belt and the density of the toner image.

The origin of the axis of abscissas indicates a state in which there is no diffuse reflection light, i.e., a state in which the intermediate transfer belt has no diffuse reflection component and there is no toner thereon. Further, a0 is representative of the reference background output value of the intermediate transfer belt, and k0 is representative of the density of the reference toner image calculated from the regular reflection output.

In FIG. 17, f(x) indicated by solid line is representative of the diffuse reflection output characteristic in a default state in which there is no fluctuation factor of the sensor output characteristic, and is stored in advance as a conversion table in the memory of the main body of the apparatus. Also, αf(x) indicated by broken line is representative of the diffuse reflection output characteristic when there is a fluctuation in the sensor output characteristic.

In the present embodiment, it is to be understood that the output of the light emitting element has lowered from the standard and the density of the intermediate transfer belt 5 has also lowered to a1 due to stains. The state is the same as a state in which the value of the reference toner density has also decreased to k1.

Also, between k1 and k0, the relation that $$k1 = k0 - (a0 - a1)$$

is established. S10 is indicative of the diffuse reflection output concerning the reference toner image, and is in the relation that $$S10 = \alpha f(k0 - (a0 - a1)). \quad (1)$$

Also, S8 is representative of the diffuse reflection output concerning the background of the intermediate transfer belt, and is in the relation that $$S8 = \alpha f(a1). \quad (2)$$

If α and a1 are calculated by solving expressions (1) and (2), the normalizing correction of the diffuse reflection output becomes possible again in this case.

Specifically, when the diffuse reflection output from the toner image is x0, the output x1 after normalized is $$x1 = x0/\alpha,$$

and a value obtained by referring to the characteristic table f(x) for X1 becomes a value of a sum of the toner density and the density of the intermediate transfer belt, and if the density a1 of the intermediate transfer belt is subtracted from the value, the result is the density of the toner image.

Thus, in the present embodiment, even when the relation between the diffuse reflection output and the toner density is not linear, it has become possible to effect the correction of the diffuse reflection output.

Figure 19:
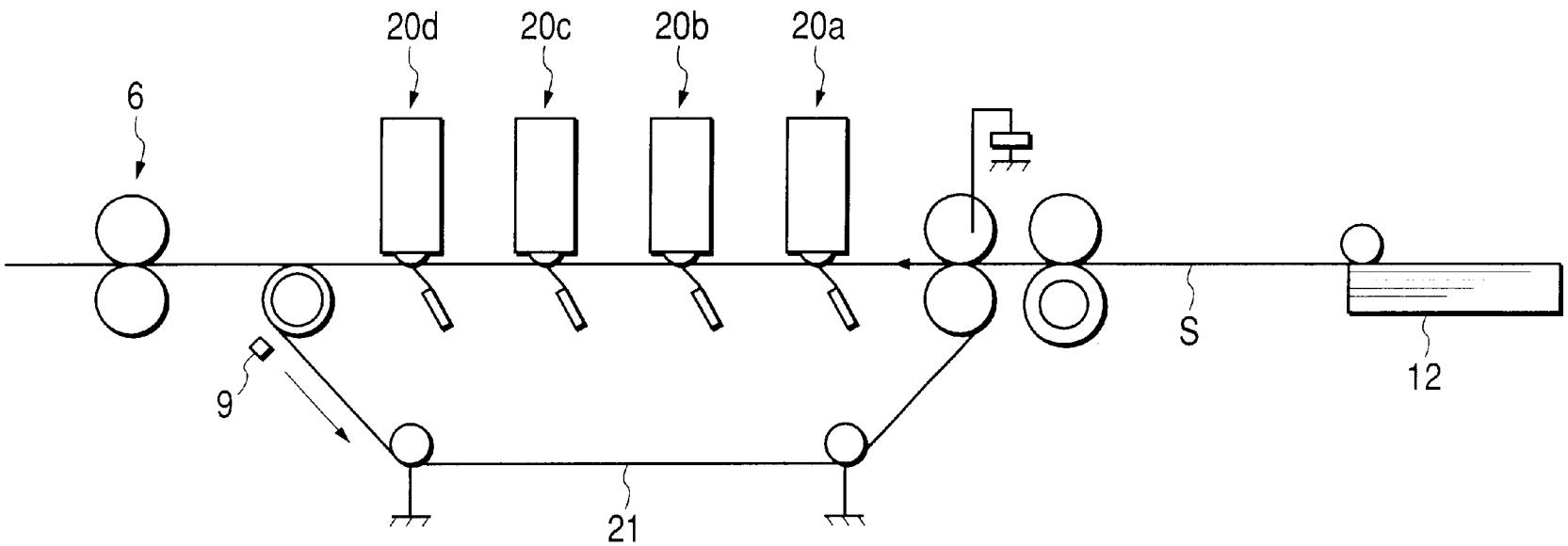
FIG. 19 shows another image forming apparatus to which the present invention is applied.

While in Embodiments 1 to 3, description has specifically been made with the intermediate transfer belt taken as an example of the density detection medium on which the toner image for density control is formed, the density detection medium is not restricted thereto, but may be other image bearing member (e.g. a photosensitive member), as described above. Particularly, the photosensitive member generally often has a diffuse reflection characteristic and is suitable for the application of Embodiments 2 and 3. Further, the density detection medium on which the toner image for density control is formed is not restricted to the image bearing member, but may also be a transfer material bearing member such as a transfer belt 21 for bearing thereon and conveying a transfer material provided along image forming means 20*a*–20*d,* as shown in FIG. 19, and in this case, there can be an effect similar to that in the case of the image bearing member such as the photosensitive member or the intermediate transfer member.

Also, while in the above-described embodiments, use is made of a sensor comprising a compound of the diffuse reflection type and the regular reflection type which is advantageous in the cost and downsizing of the apparatus, the present invention is also applicable to a case where a regular reflection type sensor and a diffuse reflection type sensor are used independently of each other.

As described above, according to the present invention, in a color image forming apparatus having an image density controlling mechanism for forming a toner image for density detection on an image bearing member or a transfer material bearing member, detecting the density of the toner image for density detection by diffuse reflection type and regular reflection type density detecting means, and controlling image forming conditions on the basis of the result of the detection thereby, the image density controlling mechanism is designed to form a reference image of a color toner on the image bearing member or the transfer material bearing member, detect reflected light from the reference image by the diffuse reflection type and regular reflection type density detecting means, and effect the correction of the output value of the diffuse reflection type density detecting means on the basis of the output value of the regular reflection type density detecting means and the output value of the diffuse reflection type density detecting means at that time and therefore, the density detection accuracy of the color toners is improved and as the result, it has become possible to obtain a color image low in cost and excellent in the stability of color reproduction.

Also, according to the present invention, in a color image forming apparatus having an image density controlling mechanism for forming a toner image for density detection on an image bearing member or a transfer material bearing member, detecting the density of the toner image for density detection by diffuse reflection type and regular reflection type density detecting means, and controlling image forming conditions on the basis of the result of the detection thereby, the image density controlling mechanism is designed to form a reference image of a color toner on the image bearing member or the transfer material bearing member, detect reflected light from the reference image by the diffuse reflection type and regular reflection type density detecting means, and effect the correction of the output value of the diffuse reflection type density detecting means on the basis of the output value of the regular reflection type density detecting means and the output value of the diffuse reflection type density detecting means at that time, and further a detection output value obtained by detecting the surface of the image bearing member or the transfer material bearing member by the diffuse reflection type density detecting means, whereby even if the image bearing member or the transfer material bearing member is of other color than black, the density detection accuracy of color toners can be improved.

Further, even when the relation between the diffuse reflection output and the toner density is not linear, it has become possible to effect the correction of the diffuse reflection output.

Furthermore, by using the diffuse reflection output in the detection of the density of the color toners, the detection accuracy of a high-density area can be improved and the excessive toner bearing in the high-density area can be suppressed and therefore, various evils such as bad fixing and bad transfer occurring when the toner bearing amount is great can be prevented.

While the embodiments of the present invention have been described above, the present invention is not restricted to the above-described embodiments, but all modifications are possible within the technical idea of the present invention.

What is claimed is:

1. An image forming apparatus comprising:

an image bearing member; and density detecting means for detecting a density of an image for density detection formed on said image bearing member, wherein an image forming condition is controlled on the basis of an output from said density detecting means, wherein said density detecting means has regular reflection type density detecting means for detecting the density by regular reflection light from a portion to be detected, and diffuse reflection type density detecting means for detecting the density by diffuse reflection light from the portion to be detected, and wherein an output value from said diffuse reflection type density detecting means is corrected on the basis of an output value from said regular reflection type density detecting means which has detected a reference image and an output value from said diffuse reflection type density detecting means which has detected said reference image.

2. An image forming apparatus according to claim 1, wherein when a regular reflection output obtained by detecting a surface of said image bearing member by said regular reflection type density detecting means is defined as P2, and a diffuse reflection output obtained by detecting a reflected light from said reference image by said diffuse reflection type density detecting means is defined as S2, and a regular reflection output obtained by detecting the reflected light from said reference image by said regular reflection type density detecting means is defined as P4, said regular reflection output P4 is normalization-corrected to thereby calculate a density D1 of said reference image, and then a reference output Si corresponding to the density D1 is calculated on the basis of a diffuse reflection output characteristic table, and from said diffuse reflection output S2 and said reference output S1, a variable ratio as of the diffuse reflection output is calculated by use of an expression $\alpha s=S2/S1$, and the image density is calculated by normalizing the diffuse reflection output value from the image by said variable ratio as, and referring to the diffuse reflection output characteristic table.

3. An image forming apparatus according to claim 1, wherein when a regular reflection output obtained by detecting a surface of said image bearing member by said regular reflection type density detecting means is defined as P2, and a diffuse reflection output obtained by detecting a reflected light from said reference image by said diffuse reflection type density detecting means is defined as S2, and a regular reflection output obtained by detecting the reflected light from said reference image by said regular reflection type density detecting means is defined as P4, said regular reflection output P4 is normalization-corrected to thereby calculate a density D1 of said reference image, and then a density D2 of said diffuse reflection output S2 is found on the basis of a diffuse reflection output characteristic table, and from said density D1 and said density D2, a variable ratio as of the diffuse reflection output is calculated by use of an expression $\alpha s=D2/D1$, and the image density is calculated by normalizing the diffuse reflection output value from the image by said variable ratio us, and referring to the diffuse reflection output characteristic table.

4. An image forming apparatus according to claim 2 or 3, wherein the normalization correction of said regular reflection output P4 is effected by calculating a variable ratio $\alpha p=P2/P1$ of the regular reflection output from a predetermined reference background regular reflection output P1 of said image bearing member and said regular reflection output P2, normalizing the regular reflection output P4 of said reference image by up, and calculating a corrected output $P3=P4/\alpha p$, and then with reference to a regular reflection output characteristic table, the density D1 is calculated from said corrected output P3.

5. An image forming apparatus according to claim 1, wherein said regular reflection type density detecting means detects a black image for density detection, and said diffuse reflection type density detecting means detects an image of a color differing from black for density detection.

6. An image forming apparatus according to claim 1, wherein a surface of said image bearing member is black.

7. An image forming apparatus according to claim 1, wherein a surface of said image bearing member has a glossy property.

8. An image forming apparatus according to claim 1, wherein said image bearing member is a photosensitive member.

9. An image forming apparatus according to claim 1, wherein said image bearing member is an intermediate transfer member.

10. An image forming apparatus comprising:

an image bearing member;

a transfer material bearing member for bearing and conveying a transfer material thereon, wherein an image on said image bearing member is transferred to the transfer material on said transfer material bearing member; and density detecting means for detecting a density of an image for density detection formed on said transfer material bearing member, wherein an image forming condition is controlled on the basis of an output from said density detecting means, wherein said density detecting means has regular reflection type density detecting means for detecting the density by regular reflection light from a portion to be detected, and diffuse reflection type density detecting means for detecting the density by diffuse reflection light from the portion to be detected, and wherein an output value from said diffuse reflection type density detecting means is corrected on the basis of an output value from said regular reflection type density detecting means which has detected a reference image and an output value from said diffuse reflection type density detecting means which has detected said reference image.

11. An image forming apparatus according to claim 10, wherein when a regular reflection output obtained by detecting a surface of said transfer material bearing member by said regular reflection type density detecting means is defined as P2, and a diffuse reflection output obtained by detecting a reflected light from said reference image by said diffuse reflection type density detecting means is defined as S2, and a regular reflection output obtained by detecting the reflected light from said reference image by said regular reflection type density detecting means is defined as P4, said regular reflection output P4 is normalization-corrected to thereby calculate a density D1 of the reference image, and then a reference output Si corresponding to the density D1 is calculated on the basis of a diffuse reflection output characteristic table, and from said diffuse reflection output S2 and said reference output S1, a variable ratio us of the diffuse reflection output is calculated by use of an expression $\alpha s=S2/S1$, and the image density is calculated by normalizing the diffuse reflection output value from the image by said variable ratio $\alpha s$, and referring to the diffuse reflection output characteristic table.

12. An image forming apparatus according to claim 10, wherein when a regular reflection output obtained by detecting a surface of said transfer material bearing member by said regular reflection type density detecting means is defined as P2, and a diffuse reflection output obtained by detecting a reflected light from said reference image by said diffuse reflection type density detecting means is defined as S2, and a regular reflection output obtained by detecting the reflected light from said reference image by said regular reflection type density detecting means is defined as P4, said regular reflection output P4 is normalization-corrected to thereby calculate a density D1 of said reference image, and then a density D2 of said diffuse reflection output S2 is found on the basis of a diffuse reflection output characteristic table, and from said density D1 and said density D2, a variable ratio as of the diffuse reflection output is calculated by use of an expression $\alpha s=D2/D1$, and the image density is calculated by normalizing the diffuse reflection output value from the image by said variable ratio as, and referring to the diffuse reflection output characteristic table.

13. An image forming apparatus according to claim 11 or 12, wherein the normalization correction of said regular reflection output P4 is effected by calculating a variable ratio $\alpha p=P2/P1$ from a predetermined reference background regular reflection output P1 of said transfer material bearing member and said regular reflection output P2, normalizing the regular reflection output value P4 of said reference image by $\alpha p$, and calculating a corrected output $P3=P4/\alpha p$, and then with reference to a regular reflection output characteristic table, the density D1 is calculated from said corrected output P3.

14. An image forming apparatus according to claim 10, wherein said regular reflection type density detecting means detects a black image for density detection, and said diffuse reflection type density detecting means detects an image of a color differing from black for density detection.

15. An image forming apparatus comprising:

an image bearing member; and density detecting means for detecting a density of an image for density detection formed on said image bearing member, wherein an image forming condition is controlled on the basis of an output from said density detecting means, wherein said density detecting means has regular reflection type density detecting means for detecting the density by regular reflection light from a portion to be detected, and diffuse reflection type density detecting means for detecting the density by diffuse reflection light from the portion to be detected, and wherein an output value from said diffuse reflection type density detecting means is corrected on the basis of an output value from said regular reflection type density detecting means which has detected a reference image an output value from said diffuse reflection type density detecting means which has detected said reference image and an output value obtained by detecting a surface of said image bearing member by said diffuse reflection type density detecting means.

16. An image forming apparatus according to claim 15, wherein when a regular reflection output obtained by detecting the surface of said image bearing member by said regular reflection type density detecting means is defined as P2, and a diffuse reflection output obtained by detecting the surface of said image bearing member by said diffuse reflection type density detecting means is defined as S6, and a diffuse reflection output obtained by detecting a reflected light from said reference image by said diffuse reflection type density detecting means is defined as S4, and a regular reflection output obtained by detecting the reflected light from said reference image by said regular reflection type density detecting means is defined as P4, a density D3 of said reference image is calculated by said regular reflection output P4, and then a reference output S3 corresponding to said density D3 is calculated by a diffuse reflection output characteristic table, and from said diffuse reflection output S4, said reference output S3, said diffuse reflection output S6 and a predetermined reference background diffuse reflection output S5 of said image bearing member, a variable ratio as of the diffuse reflection output is calculated by use of an expression $\alpha s=(S4-S6)/(S3-S5)$, and the image density is calculated by said variable ratio as and the diffuse reflection output characteristic table.

17. An image forming apparatus according to claim 15, wherein said regular reflection type density detecting means detects a black image for density detection, and said diffuse reflection type density detecting means detects an image of a color differing from black for density detection.

18. An image forming apparatus according to claim 15, wherein the surface of said image bearing member is of a color differing from black.

19. An image forming apparatus according to claim 15, wherein the surface of said image bearing member has a glossy property.

20. An image forming apparatus according to claim 15, wherein said image bearing member is a photosensitive member.

21. An image forming apparatus according to claim 15, wherein said image bearing member is an intermediate transfer member.

22. An image forming apparatus according to claim 15, wherein when a predetermined reference background density of said image bearing member is defined as a0, and a reference image density calculated from a regular reflection output obtained by detecting a reflected light from said reference image is defined as k0, and a diffuse reflection output obtained by detecting the surface of said image bearing member by said diffuse reflection type density detecting means is defined as S8, and a density corresponding to S8 is defined as a1, and a diffuse reflection output obtained by detecting said reference image by said diffuse reflection type density detecting means is defined as S10, and a density corresponding to S10 is defined as k1, a variable ratio as of the diffuse reflection output is calculated from expressions $$S10=\alpha f(k0-(a0-a1)), \text{ and}$$

$$S8=\alpha f(a1)$$

concerning said diffuse reflection output S10 and said diffuse reflection output S8, respectively, and the image density is calculated by said variable ratio $\alpha s$ and a diffuse reflection output characteristic table f (x).

23. An image forming apparatus comprising:

an image bearing member;

a transfer material bearing member for bearing and conveying a transfer material thereon, wherein an image on said image bearing member is transferred to the transfer material on said transfer material bearing member; and density detecting means for detecting a density of an image for density detection formed on said transfer material bearing member, wherein an image forming condition is controlled on the basis of an output from said density detecting means, wherein said density detecting means has regular reflection type density detecting means for detecting the density by regular reflection light from a portion to be detected, and diffuse reflection type density detecting means for detecting the density by diffuse reflection light from the portion to be detected, wherein an output value from said diffuse reflection type density detecting means is corrected on the basis of an output value from said regular reflection type density detecting means which has detected a reference image, an output value from said diffuse reflection type density detecting means which has detected said reference image and an output value obtained by detecting a surface of said transfer material bearing member by said diffuse reflection type density detecting means.

24. An image forming apparatus according to claim 23, wherein when a regular reflection output obtained by detecting the surface of said transfer material bearing member by said regular reflection type density detecting means is defined as P2, and a diffuse reflection output obtained by detecting the surface of said transfer material bearing member by said diffuse reflection type density detecting means is defined as S6, and a diffuse reflection output obtained by detecting a reflected light from said reference image by said diffuse reflection type density detecting means is defined as S4, and a regular reflection output obtained by detecting the reflected light from said reference image by said regular reflection type density detecting means is defined as P4, a density D3 of said reference image is calculated by said regular reflection output P4, and then a reference output S3 corresponding to said density D3 is calculated by a diffuse reflection output characteristic table, and from said diffuse reflection output S4, said reference output S3, said diffuse reflection output S6 and a predetermined reference background diffuse reflection output S5 of said transfer material bearing member, a variable ratio as of the diffuse reflection output is calculated by use of an expression as (S4–S6)/(S3–S5), and the image density is calculated by said variable ratio as and the diffuse reflection output characteristic table.

25. An image forming apparatus according to claim 23, wherein said regular reflection type density detecting means detects a black image for density detection, and said diffuse reflection type density detecting means detects an image of a color differing from black for density detection.

26. An image forming apparatus according to claim 23, wherein the surface of said transfer material bearing member is of a color differing from black.

27. An image forming apparatus according to claim 23, wherein the surface of said transfer material bearing member has a glossy property.

28. An image forming apparatus according to claim 23, wherein when a predetermined reference background density of said transfer material bearing member is defined as a0, and a reference image density calculated from a regular reflection output obtained by detecting the reflected light from said reference image by said regular reflection type density detecting means is defined as k0, and a diffuse reflection output obtained by detecting the surface of said transfer material bearing member by said diffuse reflection type density detecting means is defined as S8, and a density corresponding to S8 is defined as a1, and a diffuse reflection output obtained by detecting said reference image by said diffuse reflection type density detecting means is defined as S10, and a density corresponding to S10 is defined as k1, a variable ratio $\alpha s$ of the diffuse reflection output is calculated from expressions S10=$\alpha f(k0-(a0-a1))$ and S8=$\alpha f(a1)$ concerning said diffuse reflection output S10 and said diffuse reflection output S8, respectively, and the image density is calculated by said variable ratio $\alpha s$ and a diffuse reflection output characteristic table f(x).

* * * * *

UNITED STATES PATENT AND TRADEMARK OFFICE

CERTIFICATE OF CORRECTION

PATENT NO. : 6,633,734 B2
DATED : October 14, 2003
INVENTOR(S) : Yoichiro Maebashi et al.

It is certified that error appears in the above-identified patent and that said Letters Patent is hereby corrected as shown below:

Column 9,
Line 46, “up,” should read -- αp, --.

Column 11,
Line 1, “as” should read -- αs --.

Column 15,
Line 24, “as” should read -- αs --.

Column 18,
Lines 45 and 66, “as” should read -- αs --; and
Line 49, “as,” should read -- αs, --.

Column 19,
Line 2, “us,” should read -- αs, --; and
Line 11, “up,” should read -- αp, --.

Column 20,
Line 2, “output Si” should read -- output S1 --;
Line 5, “us” should read -- αs --;
Line 26, “as” should read -- αs --; and
Line 29, “as,” should read -- αs, --.

Column 21,
Lines 22, 25 and 57, “as” should read -- αs --.

UNITED STATES PATENT AND TRADEMARK OFFICE

CERTIFICATE OF CORRECTION

PATENT NO. : 6,633,734 B2
DATED : October 14, 2003
INVENTOR(S) : Yoichiro Maebashi et al.

It is certified that error appears in the above-identified patent and that said Letters Patent is hereby corrected as shown below:

Column 22,
Lines 49, 50 and 52, “as” should read -- αs --.

Signed and Sealed this

Sixth Day of April, 2004

JON W. DUDAS
*Acting Director of the United States Patent and Trademark Office*